US009890482B2

(12) United States Patent
Candrian

(10) Patent No.: US 9,890,482 B2
(45) Date of Patent: Feb. 13, 2018

(54) METHODS FOR PRODUCING AND MERCHANDISING A CUSTOM FIT PANT AND CUSTOM FIT PANTS

(71) Applicant: Natalie A. Candrian, Portland, OR (US)

(72) Inventor: Natalie A. Candrian, Portland, OR (US)

( * ) Notice: Subject to any disclaimer, the term of this patent is extended or adjusted under 35 U.S.C. 154(b) by 384 days.

(21) Appl. No.: 14/740,650

(22) Filed: Jun. 16, 2015

(65) Prior Publication Data

US 2015/0361597 A1 Dec. 17, 2015

Related U.S. Application Data

(60) Provisional application No. 62/013,452, filed on Jun. 17, 2014.

(51) Int. Cl.
*D03D 11/02* (2006.01)
*D03D 1/00* (2006.01)

(52) U.S. Cl.
CPC ..... *D03D 11/02* (2013.01); *D03D 1/00* (2013.01); *D10B 2501/04* (2013.01)

(58) Field of Classification Search
CPC . A41H 3/00; A41H 43/00; D06H 7/08; D03D 11/02; D03D 11/00; D03D 3/00; D03D 1/00; D03D 2700/0111; D03D 23/00; D05B 35/064; D05B 97/00; D05B 97/10; D10B 2501/04
USPC ..... 28/140, 153, 158, 171, 170; 2/243.1; 139/384 R, 389, 390, 384 B, 408, 409, 139/410, 413, 414; 112/475.13, 475.14, 112/475.15, 475.16, 406, 408
See application file for complete search history.

(56) References Cited

U.S. PATENT DOCUMENTS 898,941 A * 9/1908 Vogel ..... D03D 11/00 139/384 R
1,000,765 A * 8/1911 Wicke ..... D03D 11/00 139/383 R
2,246,672 A * 6/1941 Gibbons ..... D03D 3/00 139/384 R (Continued)

FOREIGN PATENT DOCUMENTS

WO PCT/US2015/036094 12/2015

OTHER PUBLICATIONS

The McCall Pattern Company, "Kwik-Sew Multi-Size Pattern," 2012.

(Continued)

*Primary Examiner* — Amy Vanatta
(74) *Attorney, Agent, or Firm* — Birdwell & Janke, LLP

(57) ABSTRACT

Methods for producing a pant, pants and methods for merchandising a pant. A pant is produced at a production facility by weaving right and left portions thereof using a multi-layer weaving process so as to produce an outer woven fly-cover layer and an inner woven left fly extension layer, or to form at least one pocket in at least one such portion, or both, and attaching the left portion of the pant to the right portion of the pant by stitching at least a portion of the crotch seam. The pant is then finished at a point of sale by stitching any remaining portion of the crotch seam and the inseams based on body dimensions and preferences of a purchaser to provide a custom fit. A pant produced at least in part by these steps is also presented.

11 Claims, 25 Drawing Sheets

(56) References Cited

U.S. PATENT DOCUMENTS

| | | | | |
|---|---|---|---|---|
| 3,286,739 | A * | 11/1966 | Itakura | A41D 27/20 139/389 |
| 4,357,714 | A | 11/1982 | Ito | |
| 4,860,900 | A | 8/1989 | Forschner | |
| 5,080,142 | A * | 1/1992 | Calamito | D03D 11/02 139/384 R |
| 5,230,764 | A | 7/1993 | Moll | |
| 5,768,135 | A | 6/1998 | Park et al. | |
| 6,349,750 | B1 | 2/2002 | Fujiwara | |
| 6,918,140 | B1 | 7/2005 | Cooper | |
| 7,331,363 | B2 | 2/2008 | Lanzi | |
| 7,350,861 | B2 | 4/2008 | Zaharakos | |
| 7,836,918 | B1 | 11/2010 | Osborne | |
| 7,841,369 | B1 | 11/2010 | Osborne | |
| 8,333,221 | B2 | 12/2012 | Ly | |
| 8,814,429 | B2 * | 8/2014 | Roether | A43B 23/024 383/117 |
| 2003/0211797 | A1 * | 11/2003 | Hill | D03D 1/0088 442/205 |
| 2005/0145150 | A1 | 7/2005 | Mortell et al. | |
| 2009/0126823 | A1 * | 5/2009 | Yengkhom | D03D 3/02 139/450 |
| 2009/0184505 | A1 * | 7/2009 | Becker | B60R 21/235 280/742 |
| 2013/0051712 | A1 | 2/2013 | Roether et al. | |
| 2013/0086726 | A1 | 11/2013 | Patercsak | |
| 2014/0068836 | A1 | 3/2014 | Tulin et al. | |
| 2015/0354105 | A1 * | 12/2015 | Veyet | D03D 11/02 139/384 R |
| 2016/0281273 | A1 * | 9/2016 | Candrian-Bell | A47C 4/54 |

OTHER PUBLICATIONS

Levi's, "Men Women Kids Sale," 1 page; no other information available.

Wikipedia, Title Unknown (apparently relating to the Jacquard process), 3 pages, Feb. 2013.

Wikipedia, "Weaving" Apr. 2014, 13 pages.

Garth Fletcher, "Some Introductory Notes Concerning Jacquard Technology," Jacquard international, 2002, 13 pages.

Author Unknown, "The Jacquard Loom, INV.50.144," 2 pages, no other information available.

Blaine Copenheaver, Notification of Transmittal of the International Search Report and the Written Opinion of the International Searaching Authority, (PCT/US2015/036094).

International Search Report and Written Opinion in PCT/US2015/036094, dated Sep. 3, 2015.

* cited by examiner

METHODS FOR PRODUCING AND MERCHANDISING A CUSTOM FIT PANT AND CUSTOM FIT PANTS

RELATED APPLICATIONS

This application claims the benefit of U.S. Ser. No. 62/013,452, filed Jun. 17, 2014, which is incorporated by reference herein in its entirety.

FIELD OF THE INVENTION

This disclosure relates to methods for producing a pant and pants that may be produced, at least in part, with such methods, methods that employ multiple layer weaving to reduce the amount of stitching and facilitate custom finishing the pant to fit the user of the pant, and methods for merchandising a custom-fit pant.

BACKGROUND

It is believed that historically the term "pant" was used to refer to one leg of two legged apparel and the term "pants" was used to refer to the combination of both legs of the apparel attached together. It is also believed that in modern times the terms "pant" and "pants" are often used interchangeably in modern times to mean one complete unit of apparel having two legs. Regardless, in this disclosure the term "pant" is used to refer to one complete unit of apparel having a left leg and a right leg, and the term "pants" is used either to refer to one unit of apparel having two legs, or as the plural of "pant," depending on the context.

Pants, particularly "blue jeans," are ordinarily made by cutting woven pant material into about ten to fifteen parts that are stitched together, first to form one side of the pant, then the other side of the pant, then to form the complete pant. Those parts are a front right leg, a back right leg, a front left leg, a back left leg, a right yoke, a left yoke, a waistband, a zipper shield, a right front pocket, a right front pocket inset, a coin pocket, a left front pocket, a left front pocket inset, a right back pocket, a left back pocket and multiple—typically five—belt loops. This entails substantial labor and time and, as a practical matter, is ordinarily done at a factory so that the pants are delivered to a store in finished form and multiple, fixed sizes.

When the parts of pants are stitched together, ordinarily the right side pockets are stitched on the front and back parts of the right leg, the left side pockets are stitched on the front and back parts of the left leg, the right and left yokes are stitched to the right and left back parts of the right and left legs, respectively, the front and back parts are stitched together at their respective inseams, and then the right and left sides are stitched together at the crotch area. The outer seams of the right and left sides, respectively, are not stitched together to form enclosed legs until all of the foregoing is finished, as doing so earlier would make the previous steps more intricate.

One way to reduce the amount of stitching required to make a garment is to use a process of multiple layer weaving known as jacquard weaving. In this weaving process, the warp threads are each individually controlled so that the weft threads may be guided above or below individual, or specific sets, of warp threads. This permits double layers of woven material to be produced simultaneously with selected portions of the two layers interwoven. The use of such a process to make a garment is disclosed in Fujiwara U.S. Pat. No. 6,349,750, which describes weaving both the front and back of a garment or shoulder bag by the jacquard process so that the front and back layers are woven together at the outer boundaries of the garment or bag. However, it does not address how to create features such as a pant pocket or a fly, which are traditional to blue jeans, or how to make the final product customized to body fit and personal preferences.

The use of the jacquard process to produce components for the back of a chair, such as a pocket for receiving cushioning material, is disclosed in Zaharakos U.S. Pat. No. 7,350,861. However, the pocket disclosed in this patent is a discrete part which is cut from a web of woven material then attached to other material comprising the back of the chair, and does not address the particular requirements of a pant pocket or pant fly, or customization of an article of clothing for an individual. Similarly, Roether et al. US Patent Application Publication No. 2013/0051712 A1 discloses the use of dual-loom technology to produce a woven bag with pockets, but does also not address the particular requirements of a pant pocket or pant fly, or customization of an article of clothing for an individual.

Accordingly, there is a need for improved methods of using multiple layer weaving processes, particularly the jacquard process, to produce a pant with a fly and one or more pockets in a more efficient way, particularly a pant that may be custom fit locally, and particularly a blue jean pant.

BRIEF SUMMARY OF THE INVENTION

Methods for producing a pant, pants and methods for merchandising a pant are presented herein.

One method for producing a pant comprises weaving a right portion of a pant using a multi-layer weaving process, the right portion comprising a right waist edge, a right crotch seam edge and right leg inseam edges; weaving a left portion of the pant using the multi-layer weaving process, the left portion comprising a left waist edge, a left crotch seam edge, and left leg inseam edges, such that a left portion of a fly is formed by separating at least one set of warp threads from another set of warp threads interlaced therewith so as to produce an outer woven fly-cover layer and an inner woven left fly extension layer in a region of the left portion above the left crotch seam portion thereof; and attaching the left portion of the pant to the right portion of the pant by fastening the left crotch seam edge to the right crotch seam edge. A pant produced at least in part by this method is also presented.

Another method of producing a pant comprises weaving a right portion of the pant using a multi-layer weaving process, the right portion comprising a right waist edge, a right crotch seam edge and right leg inseam edges; weaving a left portion of the pant using a multi-layer weaving process, the left portion comprising a right waist edge, a right crotch seam edge and right leg inseam edges; while weaving one or both of the right portion and the left portion of the pant forming at least one pocket in at least one such portion by separating at least one set of warp threads from another set of warp threads interlaced therewith so as to produce an outer pocket woven layer and an inner pocket woven layer in a region of each such portion; and attaching the left portion of the pant to the right portion of the pant by fastening the left crotch seam edge to the right crotch seam edge. A pant produced at least in part by this method is presented.

A further method of producing a custom pant, comprises weaving a right portion of the pant using a jacquard process, the right portion having a right waist edge, a right leg end edge, a right crotch seam edge, and right leg inseam edges, such that at least one pocket is formed in the right portion by an outer woven layer and an inner woven layer over a region of the right portion sharing a boarder with the right portion; weaving a left portion of the pant using a jacquard process, the left portion having a left waist edge, a left leg end edge, a left crotch seam edge, and left leg inseam edges; attaching the right portion of the pant to the left portion of the pant by at least partially fastening the right crotch seam edge to the left crotch seam edge; thereafter measuring one or more of the leg inseam length, thigh circumference, knee circumference, calf circumference and ankle circumference of a person for whom the pant is to be constructed; thereafter cutting one or more of the upper and leg inseam edges of the left and right pant portions to match one or more of the measurements so made; and thereafter stitching any remaining portions of the upper right and left inseam edges together, stitching the right leg inseam edges together and stitching the left leg inseam edges together. A pant produced by this method is also presented.

A method for merchandising a pant, comprises producing at a production facility a plurality of partially-finished pants having different sizes; producing at the production facility a plurality of finished pants having said different sizes; and shipping said partially-finished pants and said finished pants to a remote location for fitting and completion of one or more of said partially-finished pants.

Another method comprises receiving at a point of sale from said production facility a plurality of partially-finished pants having different sizes; receiving at said point of sale from said production facility a plurality of finished pants having said different sizes; making on or more of said plurality of finished pants available to a customer at said point of sale to try on to determine an appropriate size of unfinished pant; measuring one or more of the inseam length and thigh, knee and ankle circumferences for said customer; and cutting and stitching at least one of the inseam and leg ends of said appropriate size of unfinished pant according to customer measurements to finish the pant. This method of merchandising may be combined with the preceding method.

A further method for merchandising a pant comprises producing at a production facility a plurality of partially-finished pants having different sizes; providing said plurality of pants with at least one set of fasteners disposed at the inseam of the left leg and the inseam of the right leg, the fasteners being distributed generally in a direction away from the inseam; and shipping said partially-finished pants to a remote location for fitting and completion of one or more of said partially-finished pants.

Yet another method of merchandising a pant comprises, at a point of sale, receiving a plurality of partially-finished pants having different sizes and being provided with at least one set of fasteners disposed at the inseam of the left leg and the inseam of the right leg, the fasteners being distributed generally in a direction away from the inseam; making one or more of said plurality of finished pants available to a customer at said point of sale to identify an appropriate size of unfinished pant; upon identification of an unfinished pant of appropriate size, facilitating selection of positions of said fasteners to adjust the leg circumference at one or more of the locations of the thigh, knee and ankle to match the customer body dimensions and preferences; and cutting and stitching at least one of the inseam and leg ends of said unfinished pant to finish the pant based on the selected positions of said fasteners. This method may be combined with the preceding method.

Yet a farther method for merchandising pants, comprises, at a point of sale, receiving a plurality of partially-finished pants having different sizes; providing to one or more customers a description of the styles and sizes available for custom pant fitting; receiving from a customer a pant size selection and one or more of inseam, thigh, knee, calf and ankle measurements; translating said selection and measurements to an unfinished pant; and finishing the pant by removing any excess material form the inseams and stitch the inseams. This method may be combined with a preceding method of merchandising.

Another method of merchandising a pant comprises, at a production facility producing a right portion of the pant, the right portion having a right waist edge, a right crotch seam edge, a right leg end edge, and right leg inseam edges, and a left portion of the pant, the left portion having a left waist edge, a left crotch seam edge, a left leg end edge, and left leg inseam edges, and attaching the right portion of the pant to the left portion of the pant by at partially fastening the right crotch seam edge to the left crotch seam edge, while leaving the right and left leg inseam edges unfinished; transferring the pant to a point of sale; at the point of sale, measuring one or more of the leg inseam length, thigh circumference, knee circumference, calf circumference and ankle circumference of a person for whom the pant is to be constructed;

cutting one or more of the upper and leg inseam edges of the left and right pant portions to match one or more of the measurements so made; and thereafter attaching the right portion of the pant to the left portion of the pant by fastening any remaining portions of the right and left crotch seam edges together, fasting the right leg inseam edges together, and fastening the left leg inseam edges together.

It is to be understood that this summary is provided as a means of generally determining what follows in the drawings and detailed description, and is not intended to limit the scope of the invention. Objects, features and advantages of the invention will be readily understood upon consideration of the following detailed description taken in conjunction with the accompanying drawings.

DETAILED DESCRIPTION OF EMBODIMENTS

This disclosure presents a number of embodiments, or implementations of methods and articles of manufacture, derived in part from two concepts. Those concepts are the construction of a pant having pockets, a fly, leg pant ends, and written material and designs using multi-layered weaving in a way that minimizes the stitching of separate parts together, and partially constructing a pant in a mass production facility so that it can be custom fit at the point of sale.

Figure 1:
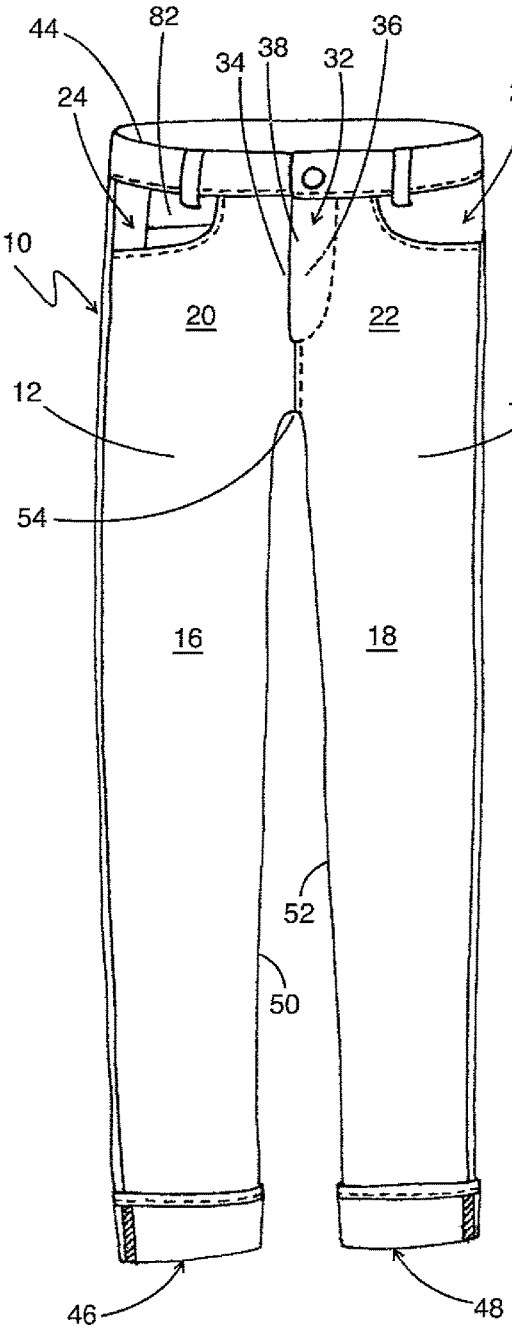
FIG. 1 is a front perspective of a finished blue jean pant made in accordance with the methods disclosed herein.
Figure 2:
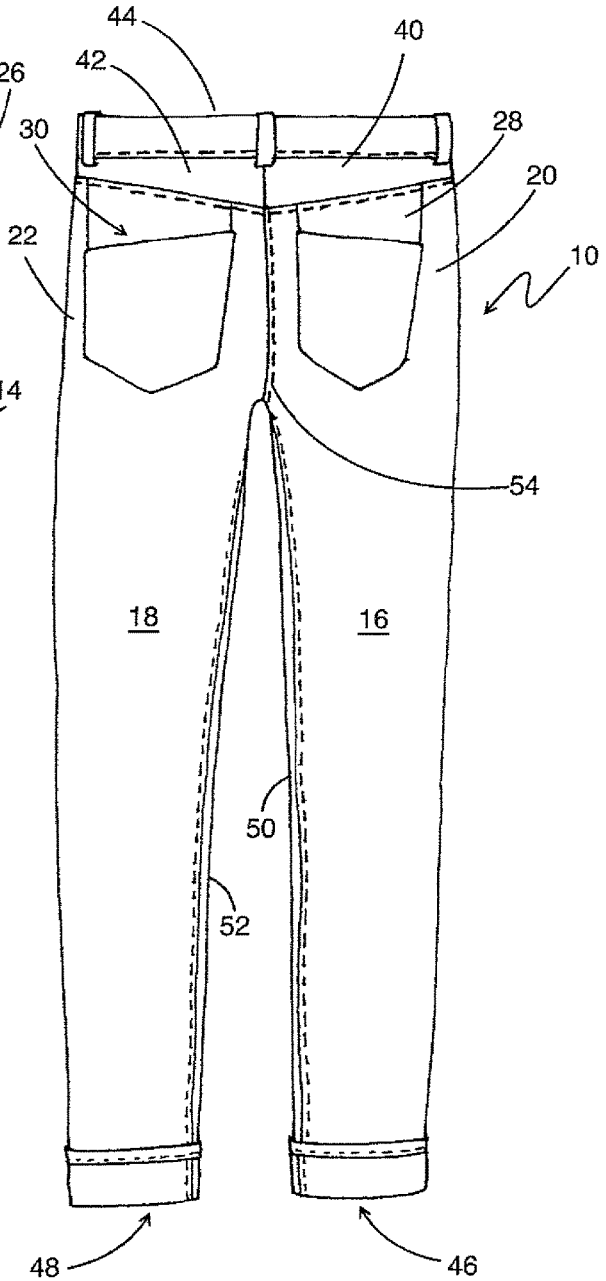
FIG. 2 is the back of FIG. 1.

FIGS. 1 and 2 show the front and back, respectively, of a pant 10 constructed in accordance with the first of the aforementioned two concepts. The pant comprises a right portion 12 and a left portion 14. The right portion and left portions 12, 14 each have respective leg portions 16, 18, and upper portions 20, 22. The upper portions cover the front and buttocks of a person. The upper portions preferably have respective front pockets 24, 26 woven and stitched therein, and respective back pockets 28, 30 woven and stitched therein, as shown in FIGS. 1 and 2, respectively. However, the pant may have as few as one pocket woven in the front or the back of the left or right portion. A coin pocket 82 may be stitched into the right front pocket.

The pant also has a fly 32 that has right fly extension 34 to support buttons or one-half of a zipper, and a left fly extension 36 to receive buttons or support the other half of a zipper, and a fly cover 38 formed as part of the left pant portion 14. The backs of the right and left portions of the pant 12, 14 have respective yokes 40, 42 disposed at the top of the pant portions, as shown in FIG. 2, to produce a rounded contour for the buttocks. A waistband 44 is disposed at the top of the pant and attached to the front of the left portion and right portion 12, 14 of the pant, as shown in FIG. 1, and to the left and right yokes 40, 42 at the back of the pant, as shown in FIG. 2. The left and right leg portions 16, 18 have respective bottom ends 46, 48 that are open.

One salient feature of the pant shown in FIGS. 1 and 2 is that, while it has respective left and right inseams 50, 52, and a crotch seam 54, it does not have left and right outer seams, pocket seams or a fly seam. Rather, at those locations the pant is a continuous weave, the pockets and fly comprising a double weave, as will be understood by persons skilled in the art. However, seam-like stylistic features may be provided at those locations by weaving and folding, as will be explained below. A preferred type of loom for weaving the pant is a jacquard loom, which permits versatile programming of each individual thread (warp and weft) creating layers within the web as well as details in texture, written information or security coding. Other types of looms or weaving techniques that may now or hereafter be available may be used to produce the same results without departing from the inventive concepts disclosed herein.

Figure 3:
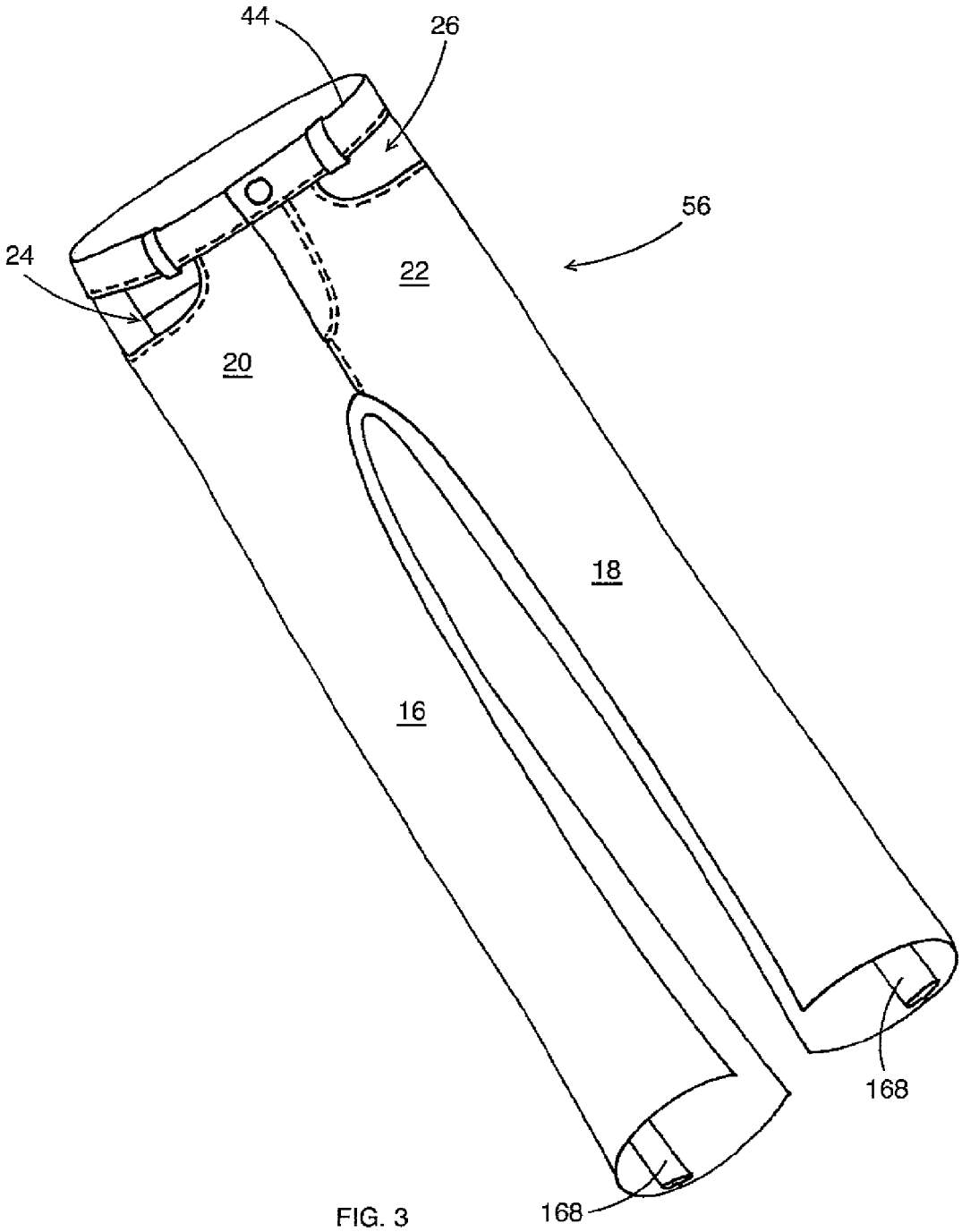
FIG. 3 is a front perspective of a blue jean pant made in accordance with the methods disclosed herein which is finished except for the inseams and a portion of the crotch seam.
Figure 4:
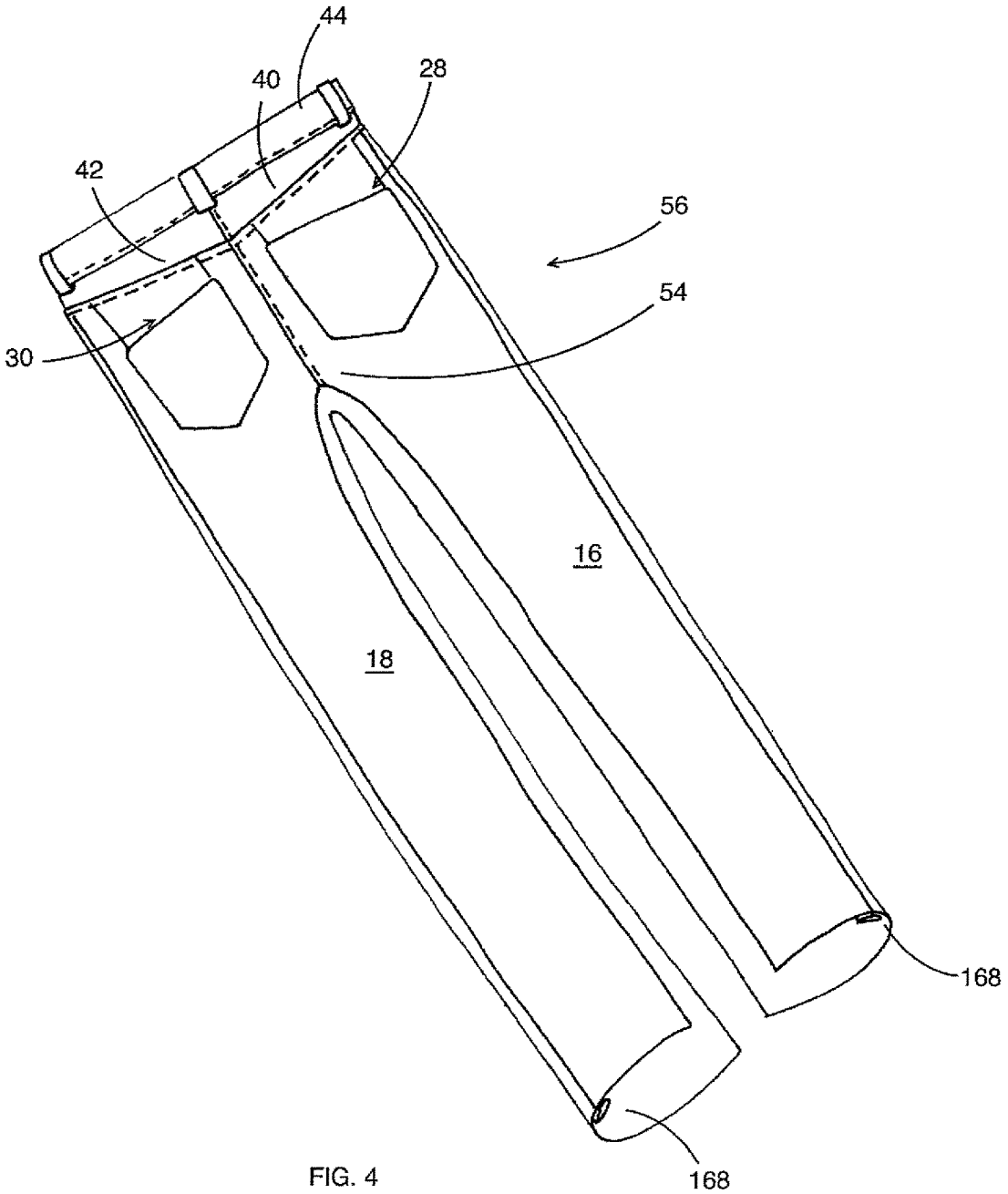
FIG. 4 is the back of FIG. 3.

Turning to FIGS. 3 and 4, which show the front and back, respectively, of an unfinished version 56 of the pant of FIGS.

1 and 2, a salient feature of the pant 10 and the method by which it is constructed is that such pants may be readily constructed in various sizes at a production facility up to, but not including, the stitching of the left and right inseams 50, 52 and at least a portion of the crotch seam, and shipped to point of sale outlets where they can be custom fit to an individual. That is, the individual may be measured at the point of sale so that the inseam may be cut and stitched to fit the individual based on those measurements, the individual may put on the unfinished pant so that a tailor can mark up the pant to fit, as is customary, or the individual may use fasteners to fit the pant to the individual's boy dimensions and preferences. The inseams and crotch seam are then cut and stitched. This is counterintuitive because in the construction of pants the inseam is ordinarily stitched before the outer seam of a pant leg for the reason that stitching the inseam after stitching the outer seam is more difficult. For the purpose of this disclosure and the claims based on this disclosure, a "production facility" shall be understood to mean any facility, not coterminous with a "point of sale," where multiple unfinished pants are constructed without regard to any particular individual. "Point of sale" shall be understood to be a location, not coterminous with a "production facility" where an individual may provide data to a pants outlet so that the outlet can use that data to custom finish the pant to fit that individual.

By way of example, but without limitation, a production facility may be located in one city, while the point of sale is located in another city. However, these are functional definitions, so it could also be that a production facility could be located in one part of a building, and the point of sale is located in another part of the same building.

As another example, a production facility may be located in one city, and points of sales may be located in retail shops in that city and many other cities. The shops may be in hotels, for example, or pants may be offered for try on and custom fitting in customers' hotel rooms. The finished pant according to customers personal fit and preferences would be delivered back to the customer's room shortly. The points of sale could even be in airports and planes, where an airplane passenger orders a pant on the plane based on known measurements and the pant is finished at or near the airport so that it is ready for the purchaser upon arrival at the gate or another location in the airport.

Figure 5:
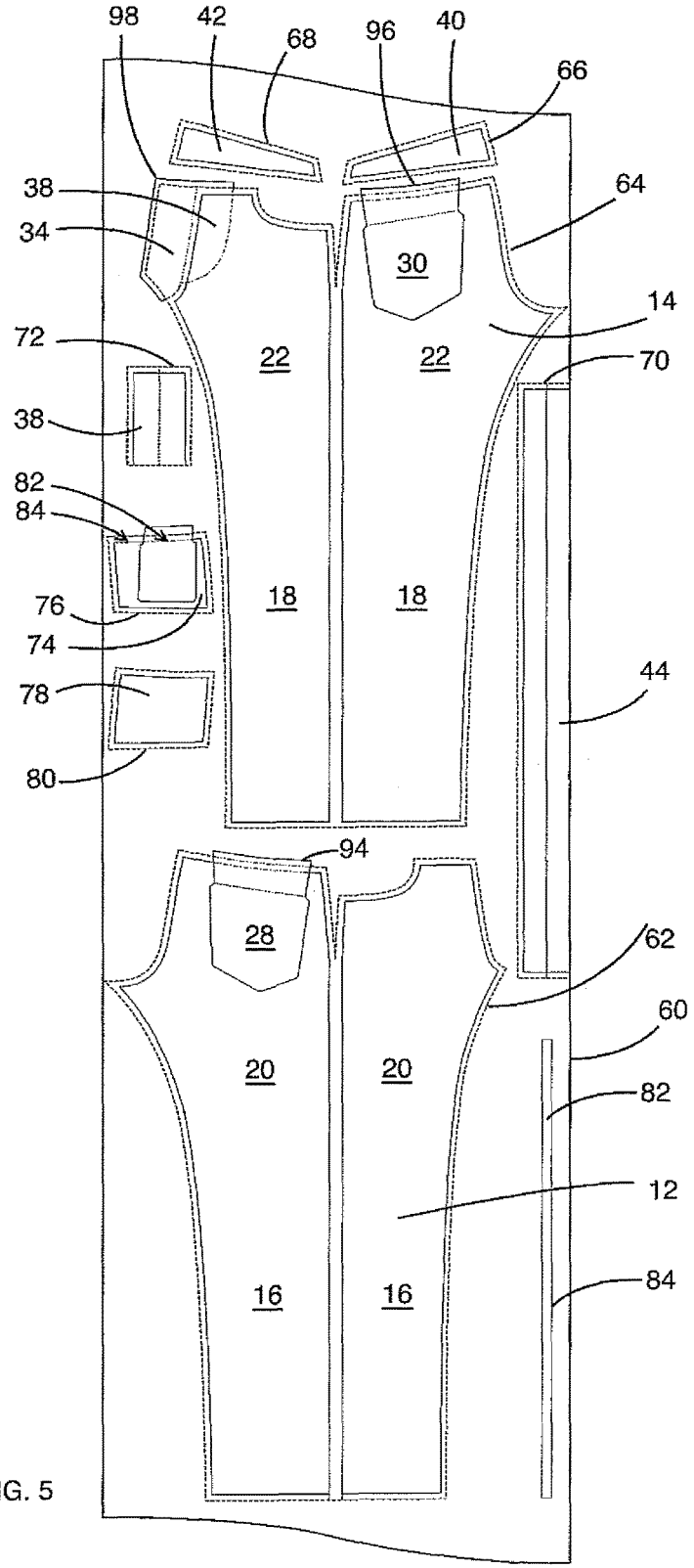
FIG. 5 is a plan of the various woven parts of a pant to be made as disclosed herein prior to being cut from the web in which they are woven.

To manufacture a pant as described herein, the parts of the pant are woven on a multiple-layer loom at a production facility as will be understood by a person having ordinary skill in the art, preferably on a common web, and preferably on a continuous web that includes multiple sets of pant parts. Each such set of parts is for a particular model and size of pant, some or all of which may be different or the same. Preferably a jacquard loom is used to weave the sets of parts. A basic set of parts for the pant shown in FIG. 1 still in a web 60 is shown in FIG. 5. They bear the same numbers as in FIGS. 1 and 2. However, the parts must be cut from the web along cut lines and stitched together, preferably entirely except for the left and right portion inseams and a portion of the crotch seam. In this example, the parts comprises the right portion 12, having cut line 62; the left portion 14, having cut line 64; the right yoke 40, having cut line 66; the left yoke 42, having cut line 68; the waistband 44, having cut line 70; the right fly extension 38, having cut line 72; a right front pocket interior 74, having cut line 76; a left front pocket interior 78, having cut line 80; and belt loop material 82, whose border is also the cutline. The right front pocket interior is stitched on the inside of the right portion front pocket 20. It includes a traditional coin pocket 82. The left front pocket interior is stitched on the inside of the left front pocket 22.

The pant is then largely, but not entirely stitched together at the production facility. Except as described below with respect to alternative embodiments, preferably all but the inseams of the two legs 12 and 14, and a lower portion of the crotch seam 54, are stitched together at the production facility. Fitting takes place, and the inseams and crotch seam are stitched as a result of the fitting, at the point of sale.

Figure 6:
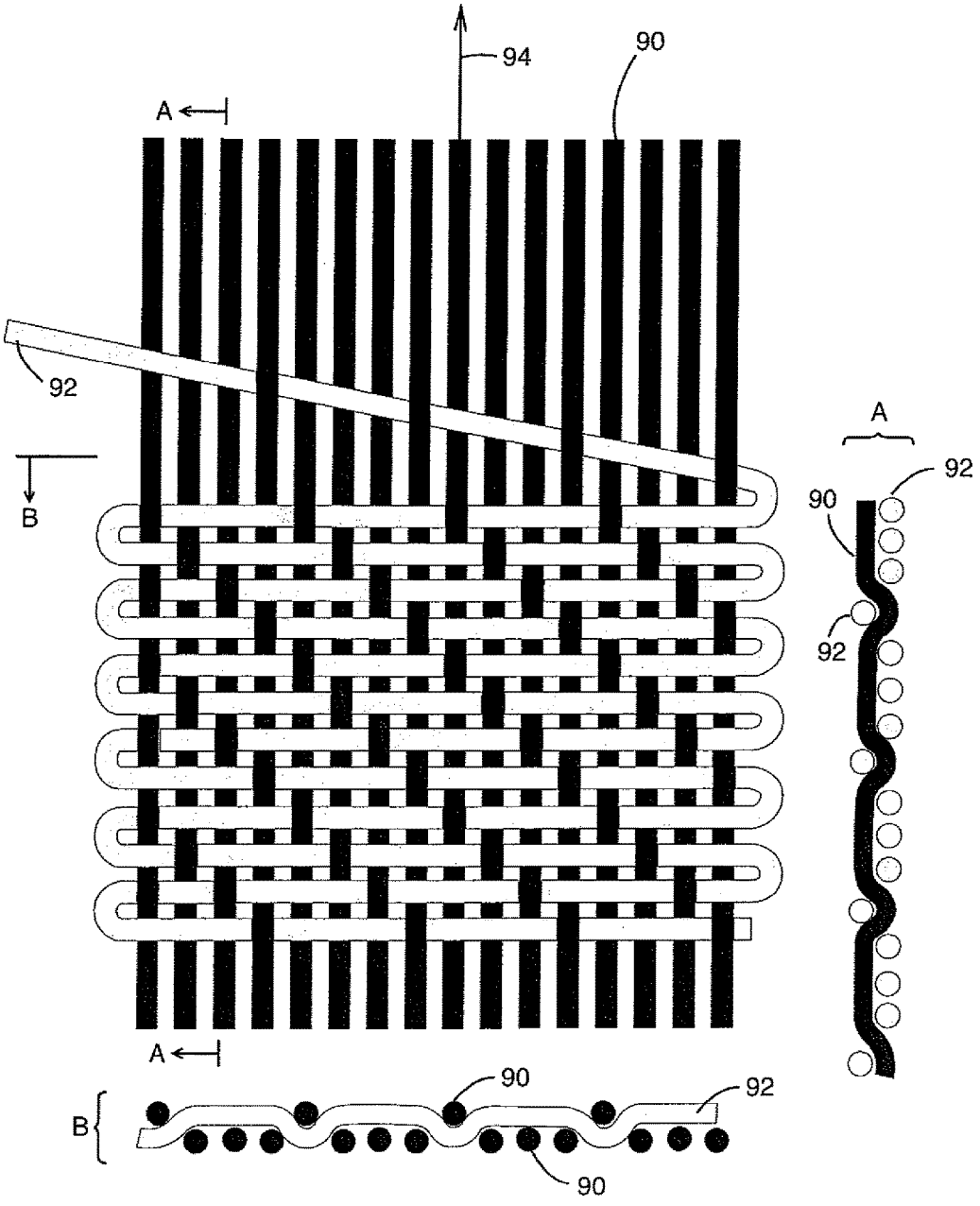
FIG. 6 is an illustration of how a denim pant material is typically woven.

The methods described herein are particularly suitable for the production, merchandizing and custom fitting of "blue jeans," that is, pants made of indigo and white cotton yarn woven as denim material, as shown for example in FIG. 6. Thus, the warp fibers 90 are blue indigo cotton, while the weft fibers 92 are white cotton. Ordinarily, as the weft proceeds through the warp, the weft goes behind three warp fibers and over one warp fiber, shifting over one warp fiber every next weft row. The interior of the material then turns out largely white, while the exterior of the material turns out largely indigo, and the pattern is diagonal to the longitudinal direction 94 of the web. This is known as a twill weave. However, it is to be understood that other material may be used without departing from principles of the methods and products disclosed and claimed herein.

Figure 7A:
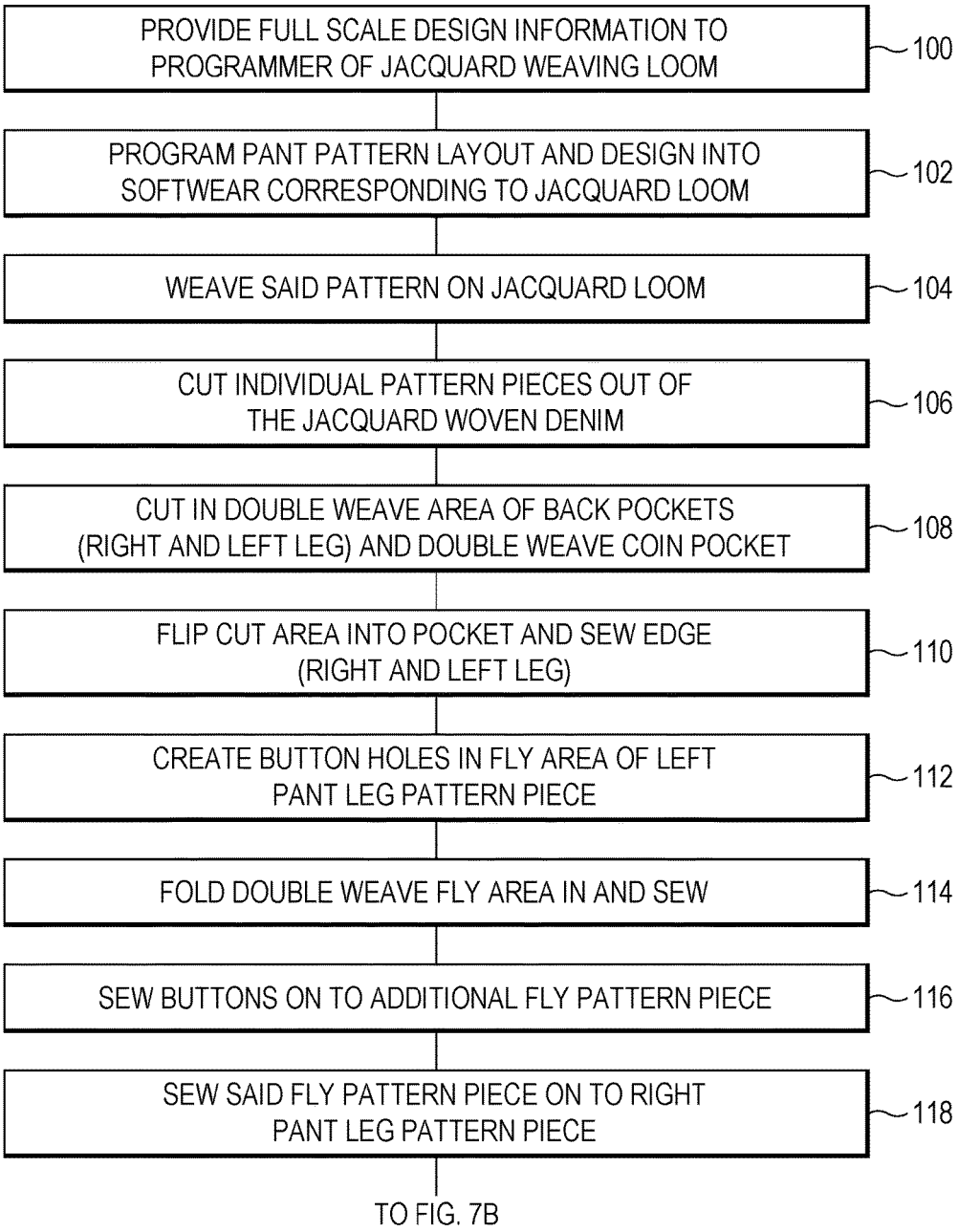
FIG. 7A is a flow chart of a method of making a pant as disclosed herein.
Figure 7B:
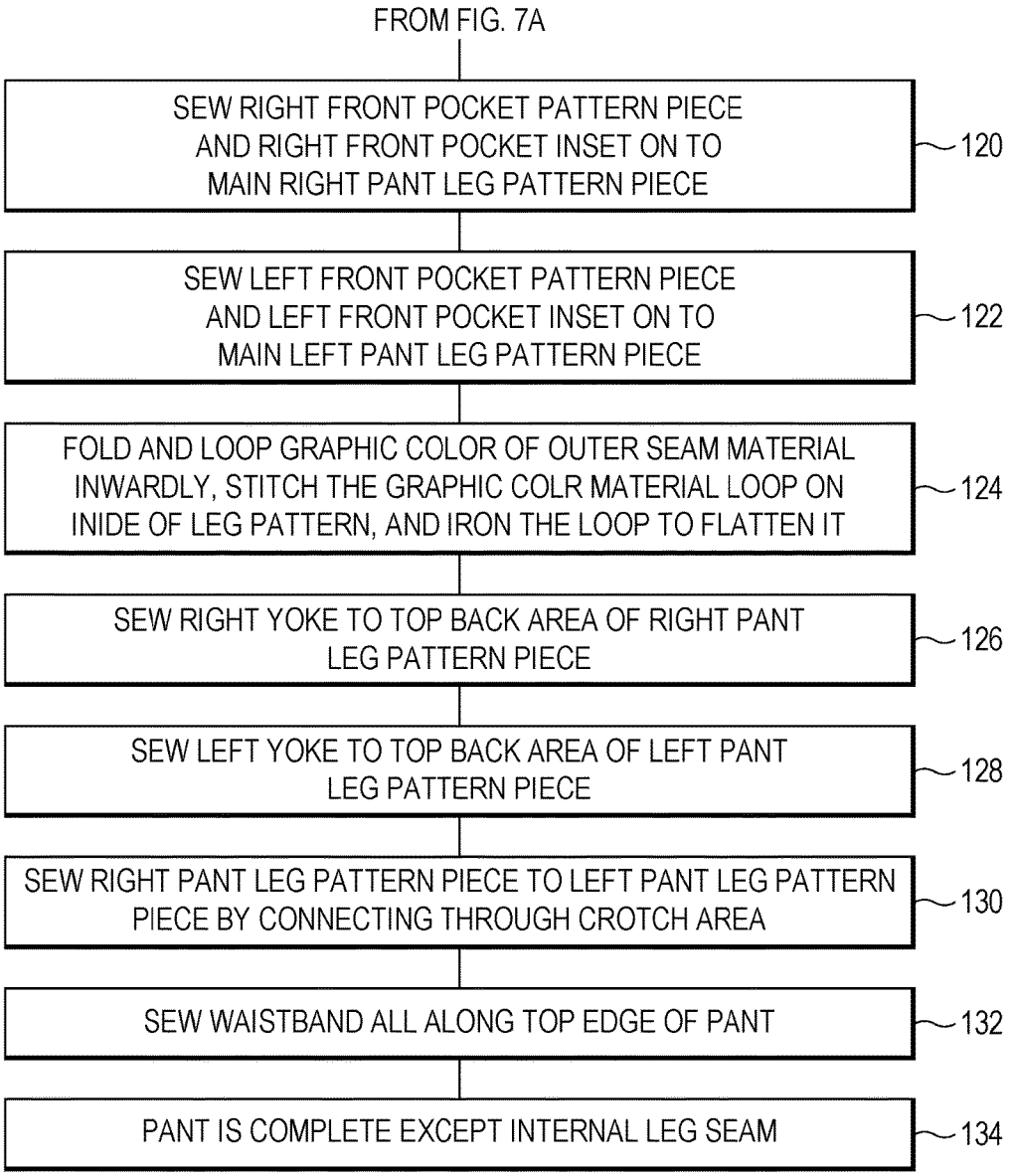
FIG. 7B is a second portion of the flow chart referred to in connection with FIG. 7A.

FIGS. 7A and 7B are two portions of a flow chart of one preferred method of producing a pant of the type disclosed herein. The actions illustrated in FIGS. 8-18 are hereafter explained with reference to the flow chart of FIGS. 7A and 7B.

First, full scale design information to program a jacquard loom, or similar multiple-layer loom, is compiled in step 100. The next step, 102, is to program the loom, as will be understood by a person having ordinary skill in the art. Next, in step 104, the loom is used to weave the patterns shown in FIG. 5. Ordinarily, the loom would be programmed and run to produce a continuous web having multiple, repeated sets of the parts for respective individual pants.

Figure 8:
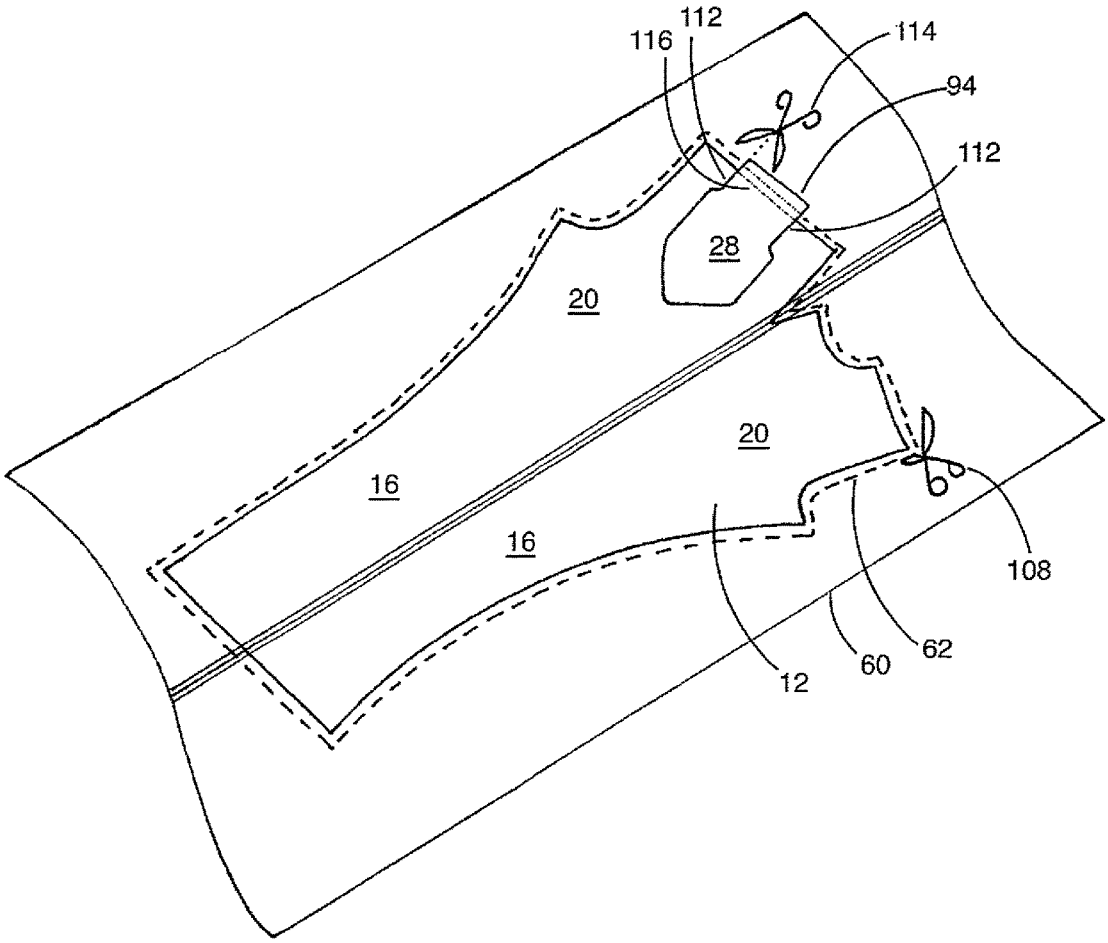
FIG. 8 is a perspective illustrating making the right side of a pant as disclosed herein, including a preliminary back pocket portion.
Figure 10:
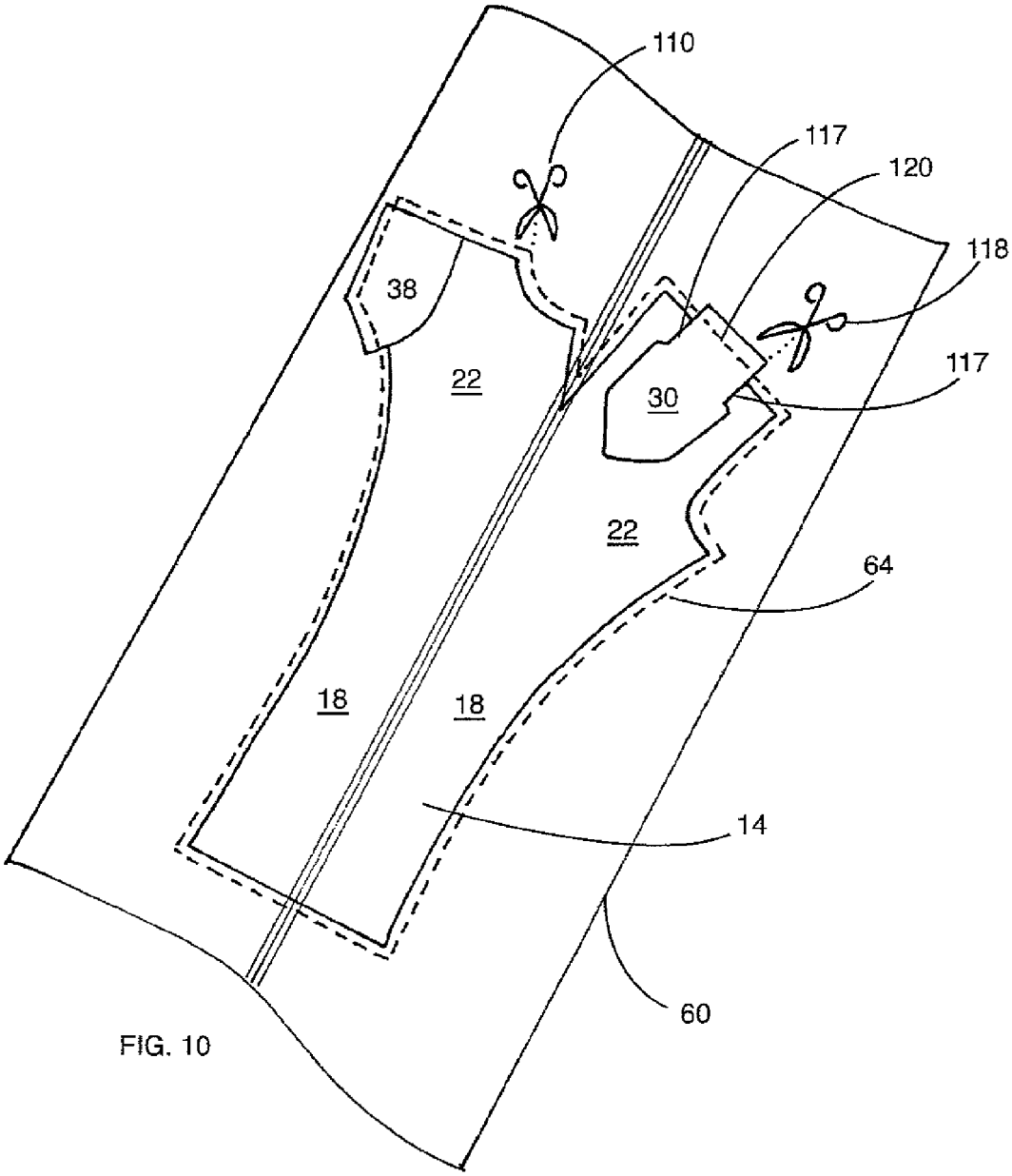
FIG. 10 is a perspective illustrating making the left side of a pant as disclosed herein, including a preliminary fly portion and a preliminary back pocket portion.

In step 106 a set of individual pant parts, as shown in FIG. 5, is then cut from the web along respective cut lines, as shown in FIG. 8 by scissors 108 and FIG. 10 by scissors 110. That is, the web is cut along cut line 62 to remove material for the right pant portion 12. The web is cut along cut line 64 to remove material for the left pant 14. A cut is made along cut line 70 to remove material for the waist band 44. Material for the right yoke 40 is removed by cutting along cut line 66, and material for the left yoke 42 is removed by cutting along cut line 68. The fly shield 38 is removed by cutting along line 72. The right pocket interior 74 is cut from the web along line 76. The left front pocket interior 78 is removed by cutting along line 80. Finally, a strip of material 82 is cut along line 84 to make belt loops.

In the pant embodiment of FIGS. 1 and 2, the right back pocket 28, the left back pocket 30, and the fly 38 are all woven so as to produce double layers of material. When the web is cut along the cut lines 62 and 64, portion 94 of the web is cut away so as to create right back pocket 28; portion 96 of the web is cut away so as to create left back pocket 30; and portion 98 of the web is cut away so as to create the opening to fly 38 Similarly, cutting along line 76 of the right front pocket interior 74 produces coin pocket 82.

Figure 9:
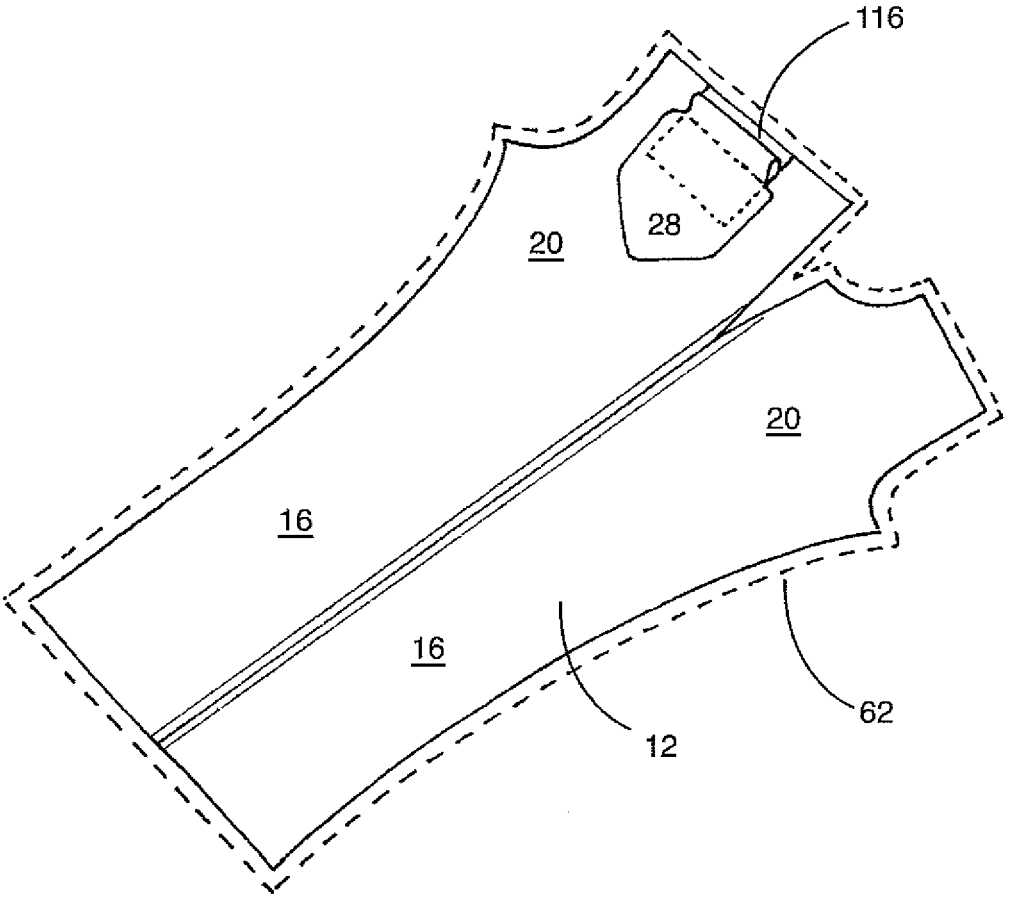
FIG. 9 is a perspective illustrating how the right side of the pant is completed, including the back pocket of the pant.

Referring specifically to FIG. 8, in step 110? the upper edges 112 of right back pocket 28 are partially cut, as shown by scissors 114, to form a flap 116 which is folded into the pocket and stitched in place to fault a pocket lining, as shown in FIG. 9. Referring specifically to FIG. 10, the upper edges 116 of left back pocket 30 are also cut, as shown by scissors 118, to form a flap 120 which, as in the case of right back pocket 28, is folded into left back pocket 30 to form a pocket lining.

Figure 11:
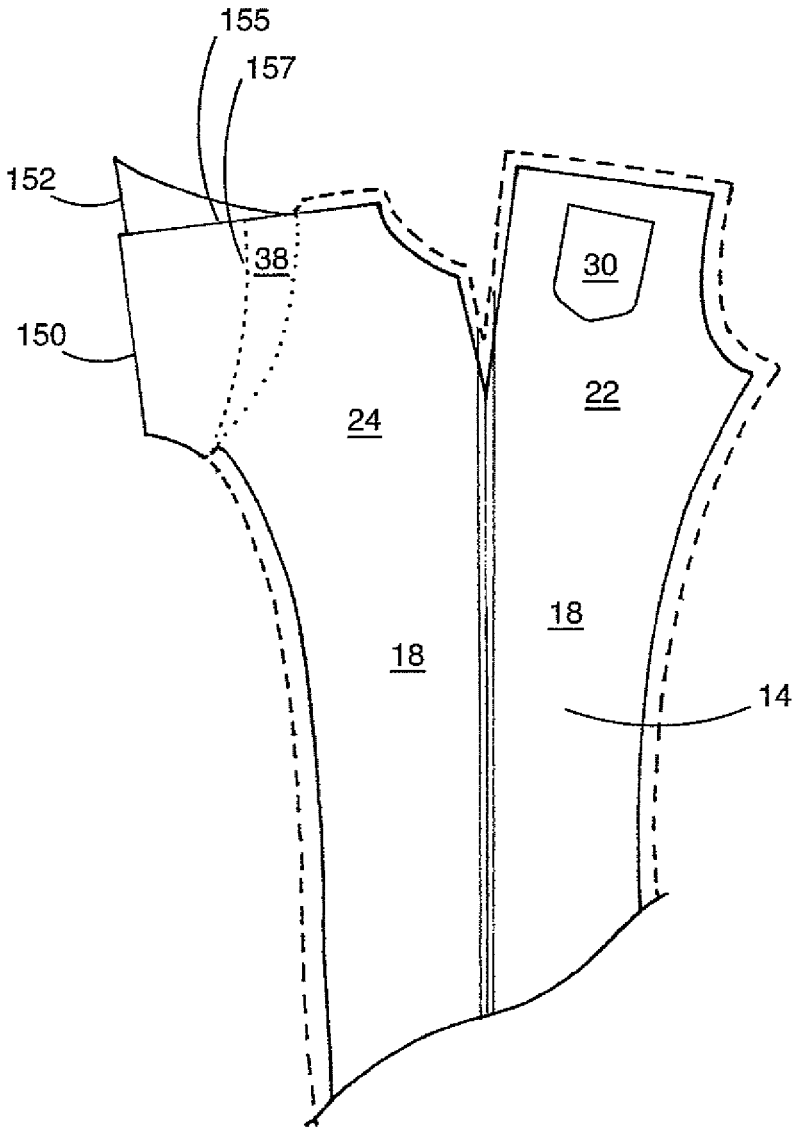
FIG. 11 is a perspective illustrating the left side of the pant of FIG. 10 cut from the web and the two resulting free layers of the fly.
Figure 12:
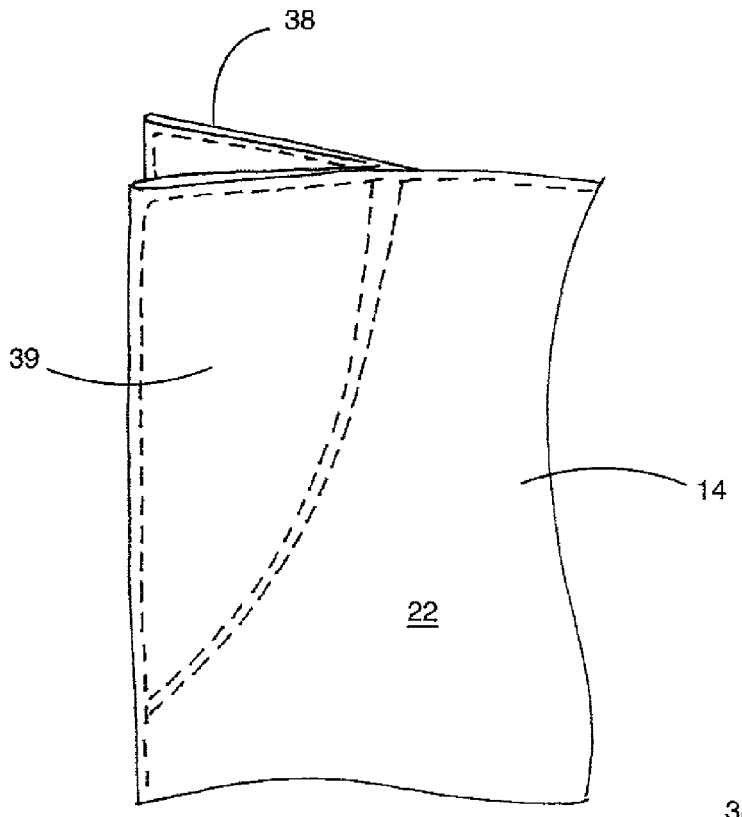
FIG. 12 is a perspective illustrating completion of the flaps of the fly in the left side of the pant of FIG. 10.
Figure 13:
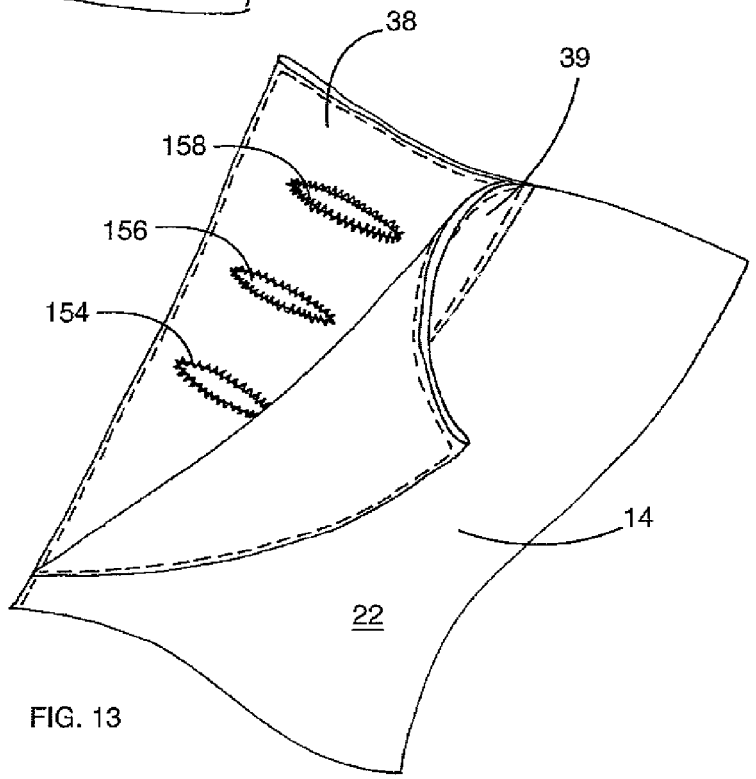
FIG. 13 is a perspective of the completed fly in the left side of the pant of FIG. 10, including stitched button holes.
Figure 14:
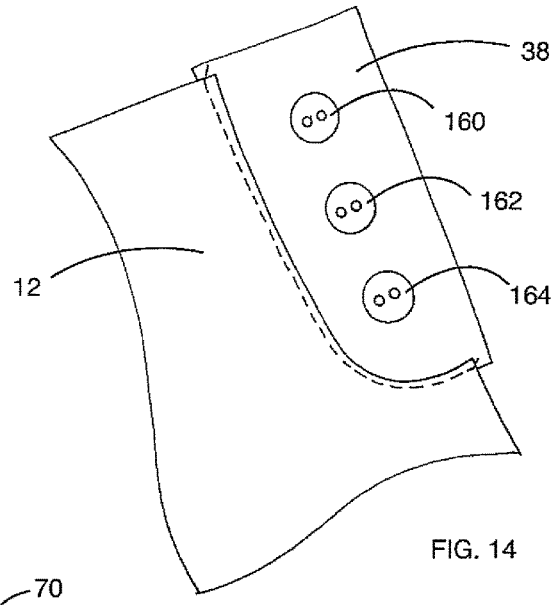
FIG. 14 is a perspective of a left fly extension stitched to the right side of the pant of FIG. 10.

The fly may employ buttons or a zipper, as will be understood by a person familiar with pants and with traditional blue jeans. It could also employ some other type of fastener. Referring to FIGS. 11, 12 and 13, the double layer weave of the fly and subsequent cutting of the fly out of the web results in two flaps 150 and 152. In this example, as step 112, button holes 154, 156 and 158 are cut into the fly. Then, in step 114 the flaps 150 and 152 are folded inwardly along lines 155 and 157, respectively, and stitched in place, thereby forming the right fly extension 38 and the fly cover 39 on the left portion of the pant 14, as shown in FIG. 12. The button holes are stitched to prevent the cut material from fraying, as shown in FIG. 13. In step 116 three buttons 160, 162 and 164, corresponding to the button holes 154, 156 and 158, are stitched onto the right fly extension 38. In step 118, the fly shield 36 is attached to the right portion of the pant a shown in FIG. 15.

Next, in step 120, a right front pocket pattern piece is cut out of separate material, preferably white twill cotton that is not part of the denim cotton web. This pattern piece and the right front pocket inset are stitched to the right front leg upper portion 20 to form the inside of the right front pocket. Then, in step 122, a left front pocket pattern piece cut out of separate material, preferably white twill cotton, and the left front pocket insert are stitched to the left front leg upper portion 22 to form the interior of the left front pocket.

Figure 16:
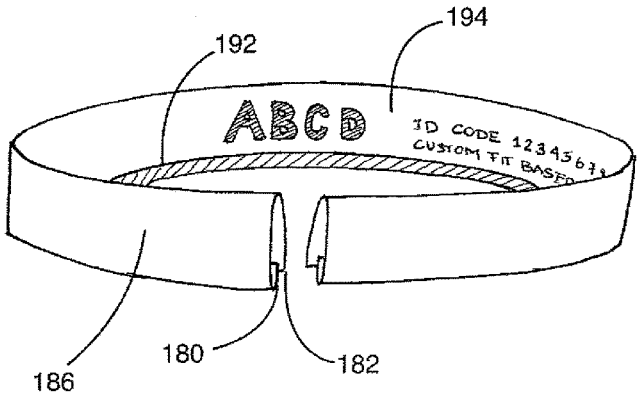
FIG. 16 is a perspective illustrating making a waistband from the portion of material shown in FIG. 15.
Figure 17:
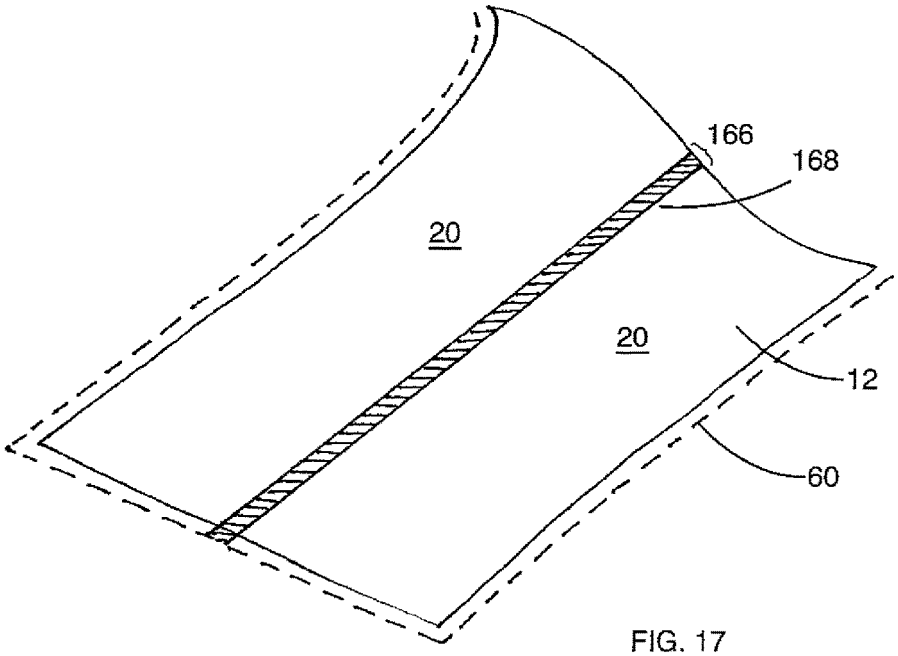
FIG. 17 is a perspective of a portion of a right side of a pant made as disclosed herein, illustrating decorative material woven into the material which will form the outside seam of the pant leg, as shown in FIGS. 1-4.
Figure 18:
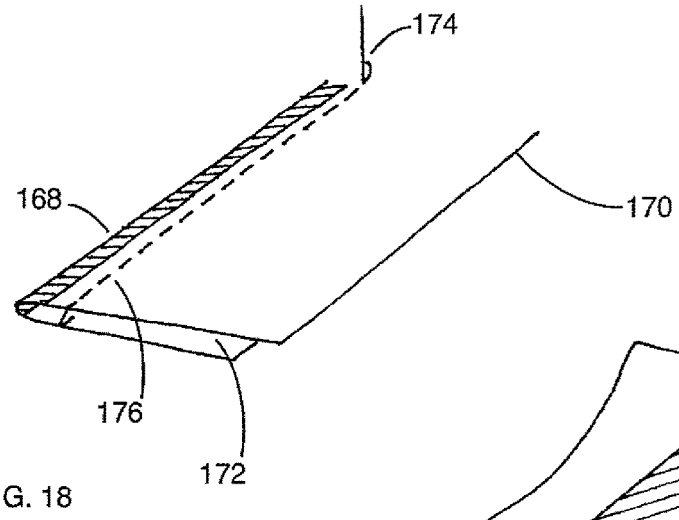
FIG. 18 illustrates the first, folding and stitching step of forming the outside leg seam from the right side of the pant shown in FIGS. 1-4.
Figure 19:
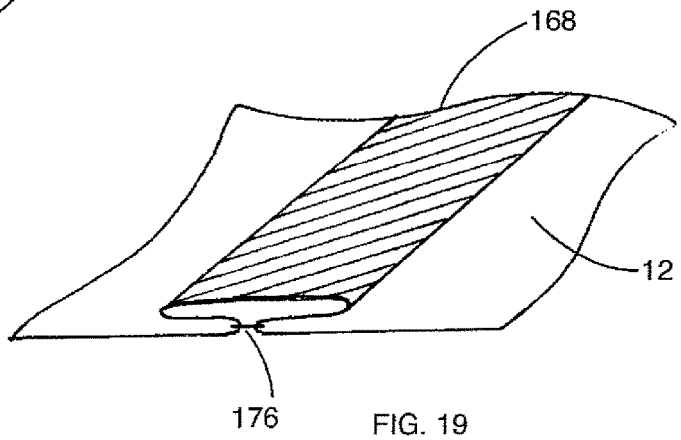
FIG. 19 illustrates the second, re-folding step of forming the outside leg seam from the right side of the pant shown in FIGS. 1-4.

Preferably and outer faux seam is formed on each pant leg. To that end, each leg portion includes extra material along the outside seam line so that it can be folded inwardly, looped and stitched inside the leg to look like a conventional seam. One advantage of this is fewer parts to stitch together. Another particular advantage is the ability to weave a decorative pattern in the seam material which can be seen on the inside of the jean when pant leg is folded inside out, as has long been a popular practice with blue jeans. Thus, turning to FIGS. 16-19, right leg portion has an extra wide seam portion 166 that includes a decorative pattern woven astraddle the seam line, as shown in FIG. 16. To form the seam in step 124, the leg portion is folded inside out at the seam line and the two folds 170 and 172 are stitched together by, for example, needle 174 along line 176 spaced a short distance from the decorative pattern 168. The two folds are then unfolded along the stitch line 176, the decorative portion 168 is spread evenly about the stitch line 176, and the decorative portion is then ironed, as shown in FIG. 19, to flatten the seam allowance inside the leg.

Figure 20:
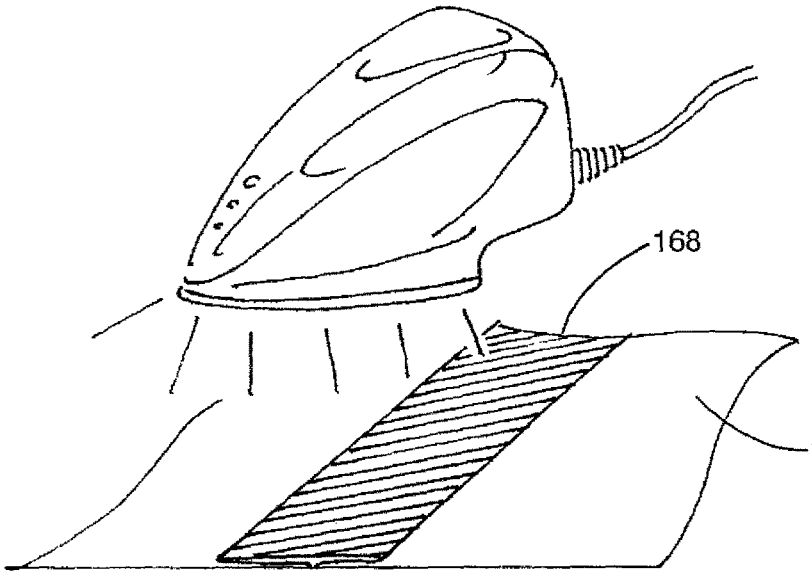
FIG. 20 illustrates the last, ironing step of forming the outside leg seam from the right side of the pant shown in FIGS. 1-4.
Figure 21:
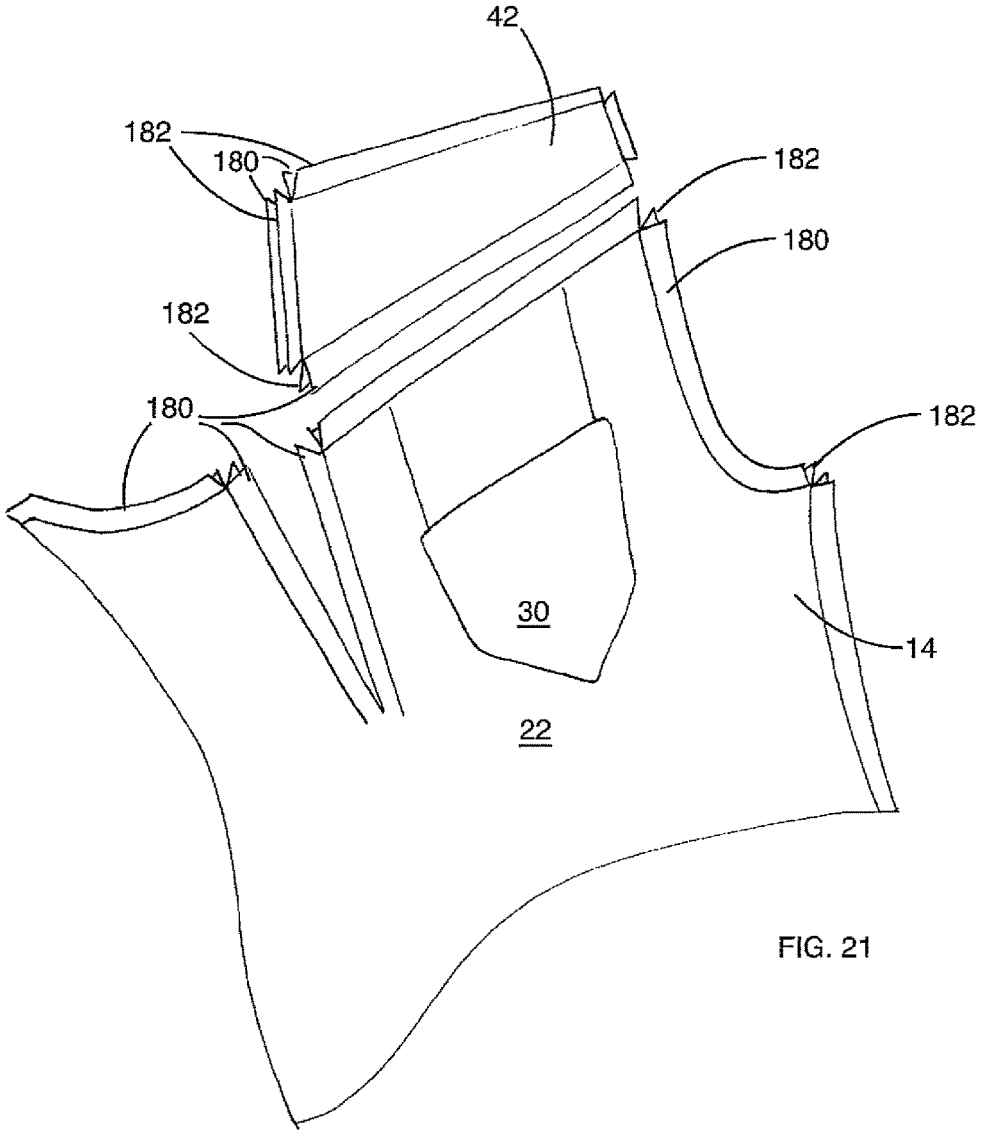
FIG. 21 illustrates connection of the yokes to respective back sides of a pant made in accordance with the methods disclosed herein.

Ordinarily, the yokes would be attached to the back sides of the right and left portions of the pant at this time in step 126 and step 128, respectively. This could be done by standard seams formed between a yoke 42 and its corresponding top back of the pant portion in a conventional way, as will be understood by a person skilled in the art. However, a preferred embodiment will have double layer weaving at the edges of the parts so that when they are cut from the web two seam flaps 180 and 182 are formed along the seam edges, as shown in FIG. 20. This enables the seams to be interleaved and stitched together for strength. Alternatively, two of the flaps of one part may be folded under with the flaps of the adjoining part inserted therein, and the entire seam formed thereby stitched together as indicated by needle 184 in FIG. 21.

Turning to step 130, the right pant portion 14 is now stitched to the left pant portion to form the crotch seam 54, while preferably leaving the inseams 50 and 52 of the right and left leg portions, respectively, unfinished.

Figure 15:
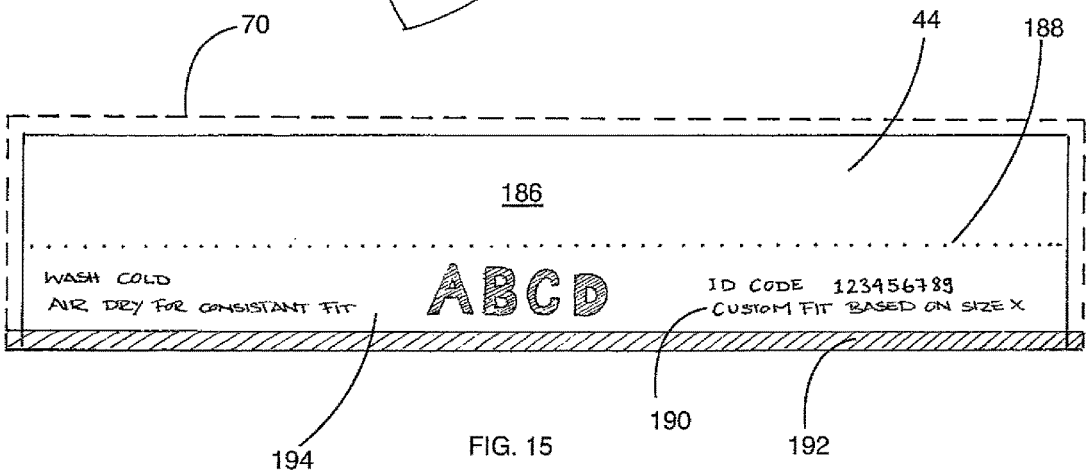
FIG. 15 is a plan view of an unfinished waist band portion of material for a pant made as disclosed herein cut from the web, including information woven directly therein.

In step 132, belt loops are cut and formed from web strip 82 are stitched to the outer portion 186 of the waistband after waistband is attached to right and left pant leg, and the waistband 44 is folded about line 188, as shown in FIG. 15, and stitched to the tops of the fronts of right pant portion 12 and left pant portion 14, respectively; to the top of right yoke 42; and to the top of left yoke 42. Written material is woven into the waistband by controlling the white weft yarn to show up in great detail through the indigo died warp yarn to create letters and codes regarding the finished pant. The written material, such as informational material 190, and selvedge of woven web 192 end up on the inside 194 of the waistband. This makes the pant complete except for the internal leg seams, a portion of the crotch seam, and the stitching at the bottom of the leg, for total completion at the point of sale, as indicated by step 134.

Figure 22:
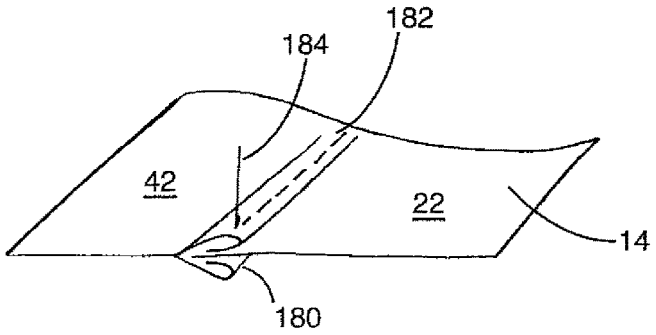
FIG. 22 shows the preferred manner in which the left side, right side, yokes and waist band are stitched together to form a pant made in accordance with the methods disclosed herein.
Figure 23:
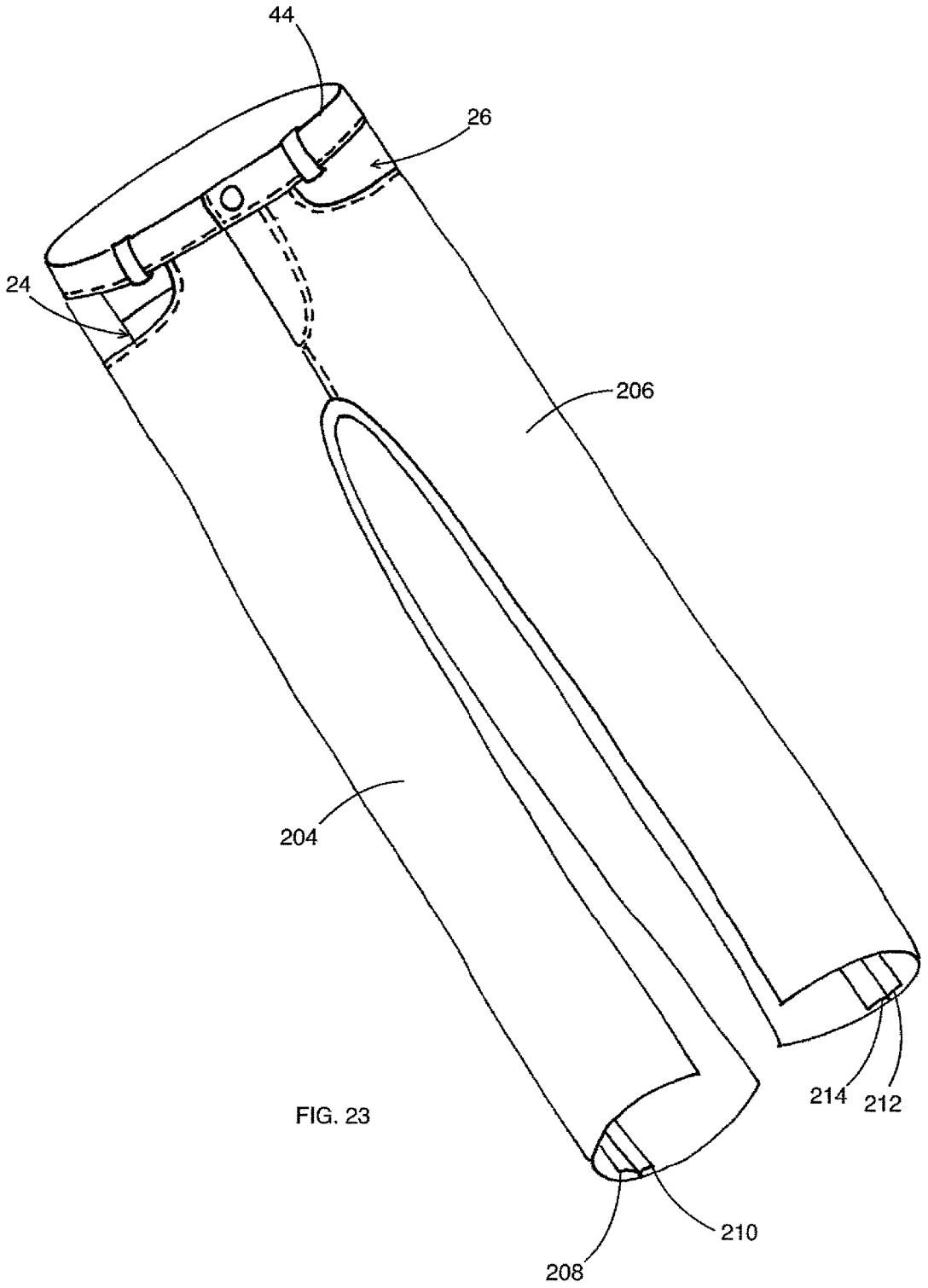
FIG. 23 is a front perspective of a blue jean pant made in accordance with the methods disclosed herein which is finished with alternative, traditional outside seams and unfinished inseams.
Figure 24:
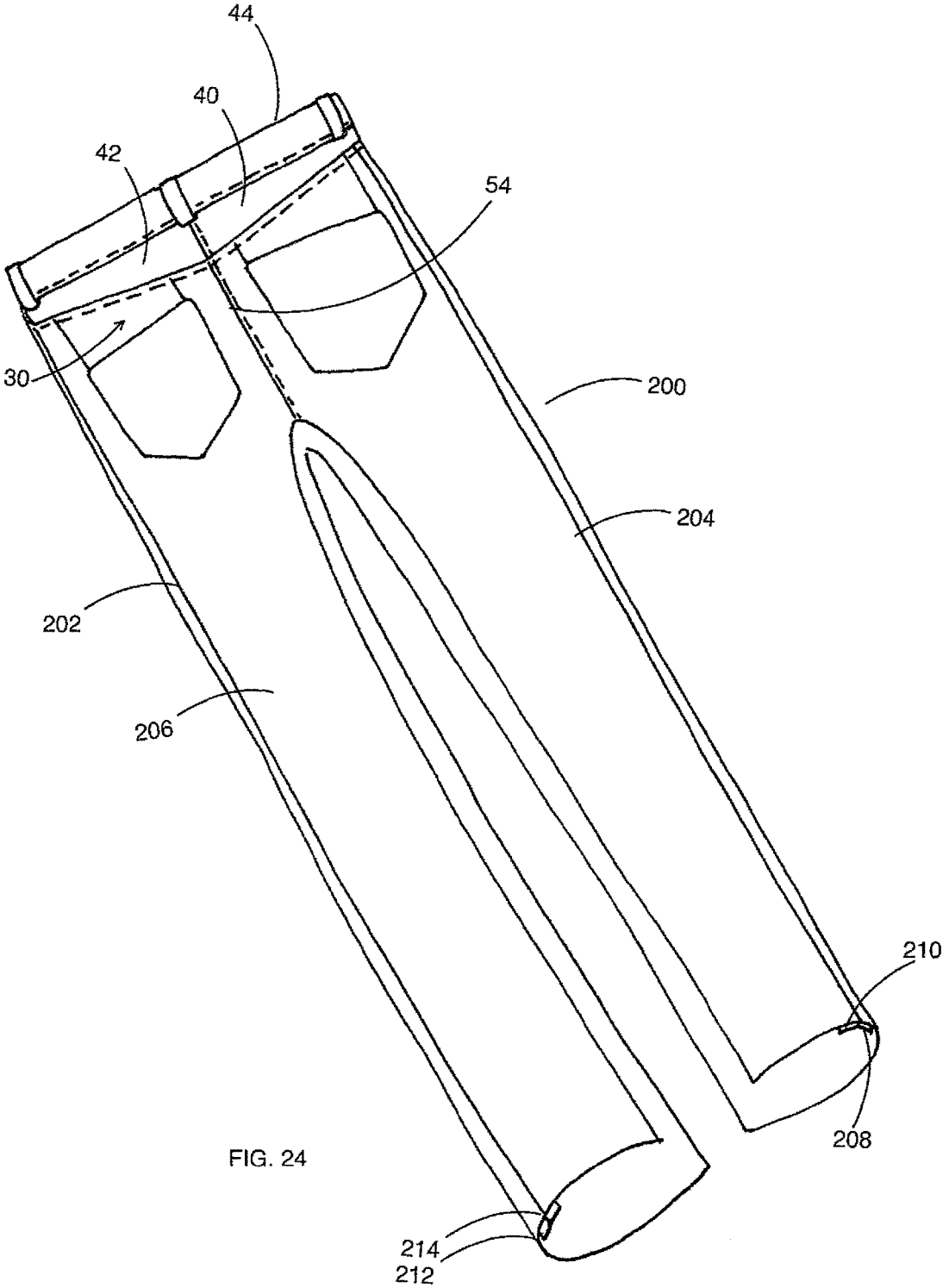
FIG. 24 is the back of FIG. 23.

An alternative embodiment of a patent according to the methods described herein is shown in FIGS. 22 and 23, unfinished at the leg inseams, as is the case with the pant shown in FIGS. 3 and 4. This pant has all of the same parts as the pant in FIGS. 3 and 4, except that the outer seems 200 and 202 of the right leg portion 204 and the left leg portion 206, respectively, are not woven; rather, they are stitched together in a traditional way such that the seam material 208, 210 from the right front and back and 212, 214 from the left front and back, respectively, is folded over and stitched in place on the inside of the right and left legs, respectively.

According to the merchandising method disclosed herein, like the unfinished pant of FIGS. 3 and 4, the unfinished pant of FIGS. 22 and 23 may be delivered to the point of sale, where they are custom fit to a purchaser and finished at that location.

Figure 25:
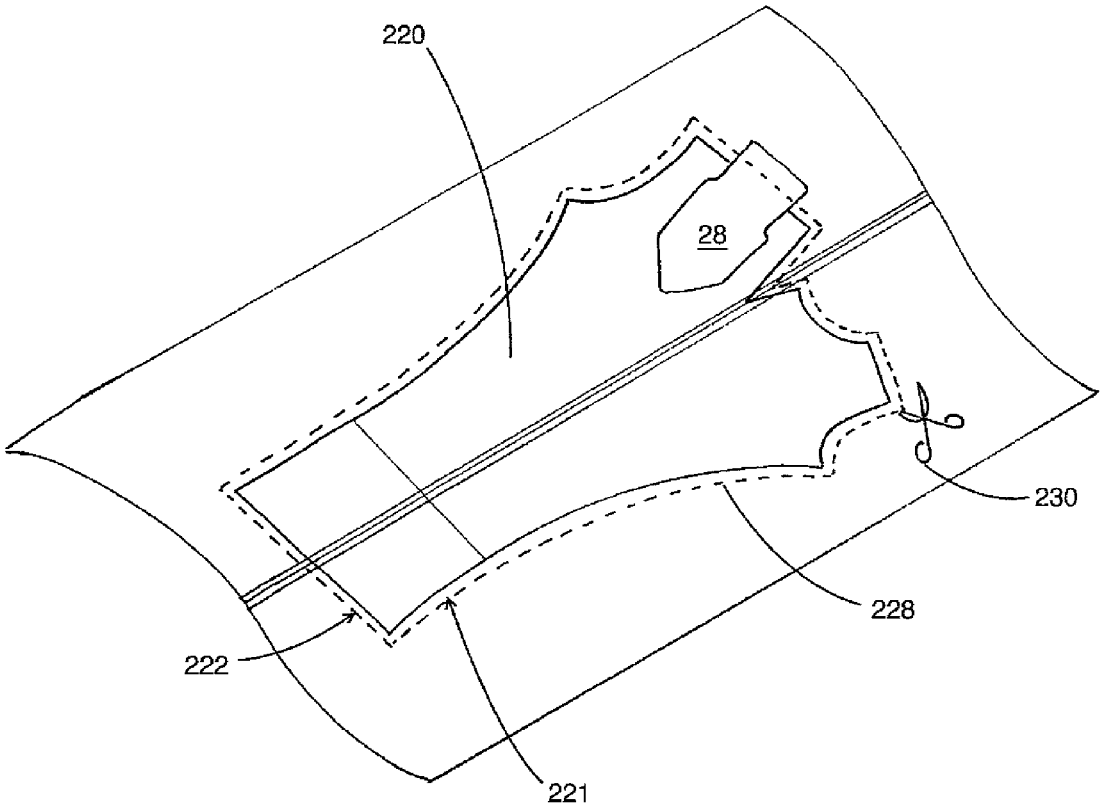
FIG. 25 is a perspective of a right side portion of a pant made in accordance with the methods disclosed herein while still in the web, including an alternative double woven leg end.

An alternative embodiment of a right pant portion 220 is shown in FIGS. 24 through 27. This would be accompanied by a corresponding right pant portion, which is not shown but would be made in the same way. When this embodiment is woven, the leg end 221 is double woven in the web so as to produce distinct inside and outside layers 222, 224 below a breakpoint 226 in the pant, as shown in FIG. 25, when the pant portion is cut from the web along cut line 228, as shown by scissors 230 in FIG. 24.

Figure 26:
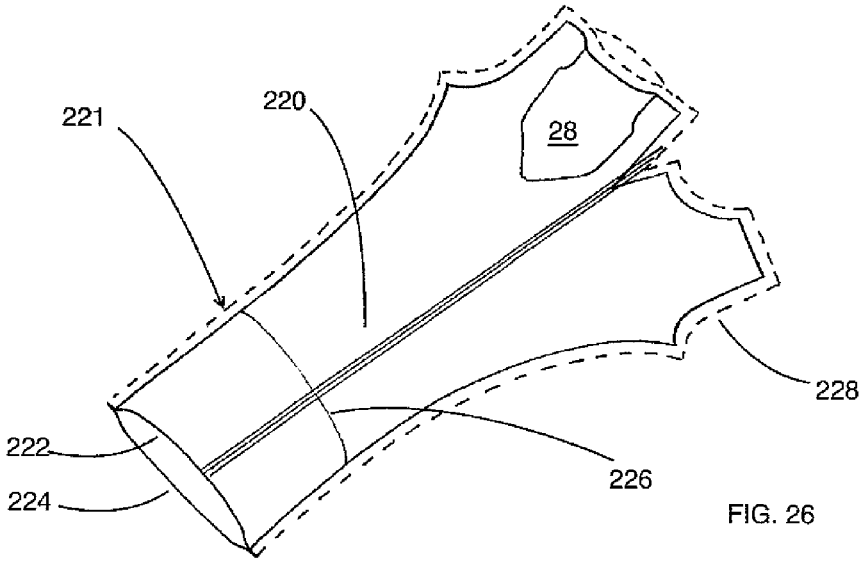
FIG. 26 is a perspective of the right side portion of FIG. 25, cut from the web showing double layer woven leg end and a back pocket.
Figure 27:
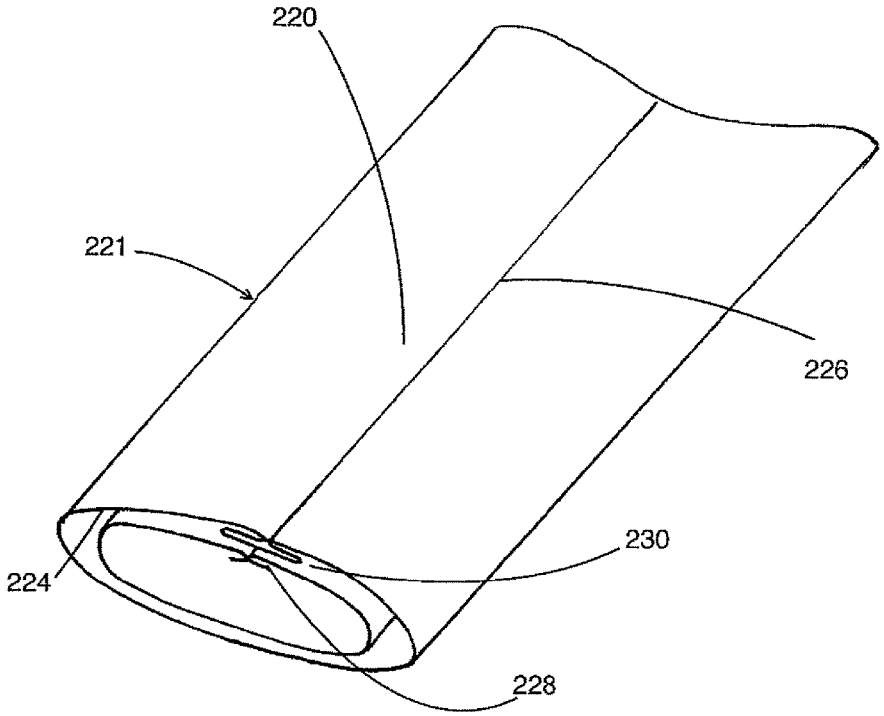
FIG. 27 is a perspective of the right side portion of FIG. 25, finished except for the leg end and inseam.

The purpose of the distinct inside and outside layers 222, 224 is to enable the length of the pant leg to be more readily changed, as in the case of an adolescent whose leg length is still growing, or simply as styles change. Accordingly, when the pant is purchased the leg width is custom fit and the inseams for each leg, as represented by inseam 226 of the right leg portion 220 in FIG. 26, are stitched for each leg. In this case, the outside seams of the outside and inside layers are faux seams 228, 230, as explained with respect to FIGS. 16 through 19, while the inseams are left unfinished until the pant is purchased.

Figure 29:
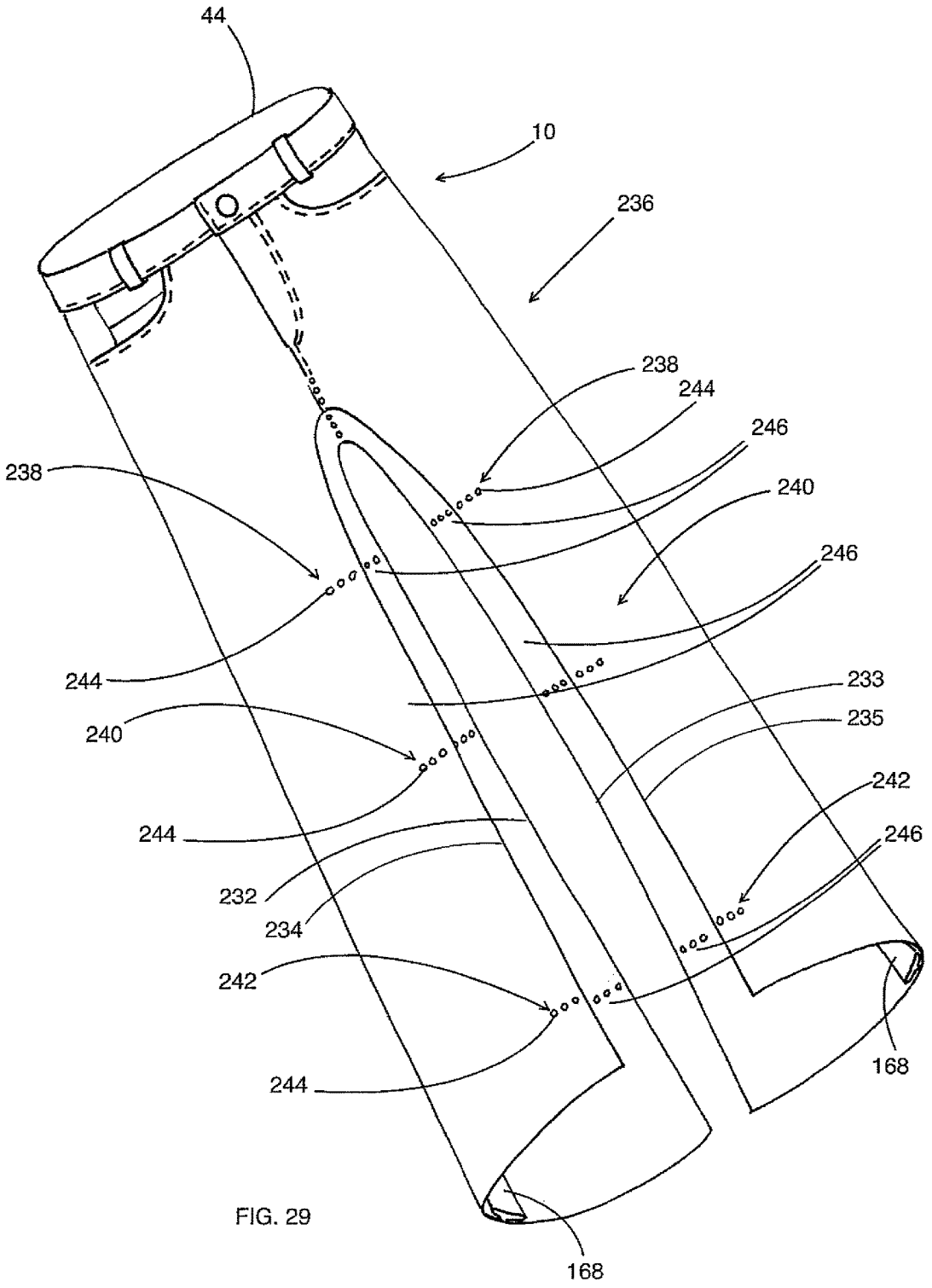
FIG. 29 is a perspective of the pant of FIG. 3, further including sets of magnetic fasteners embedded along the unfinished inseams and in a direction perpendicular thereto for adjusting the leg widths and crotch length during fitting.
Figure 30:
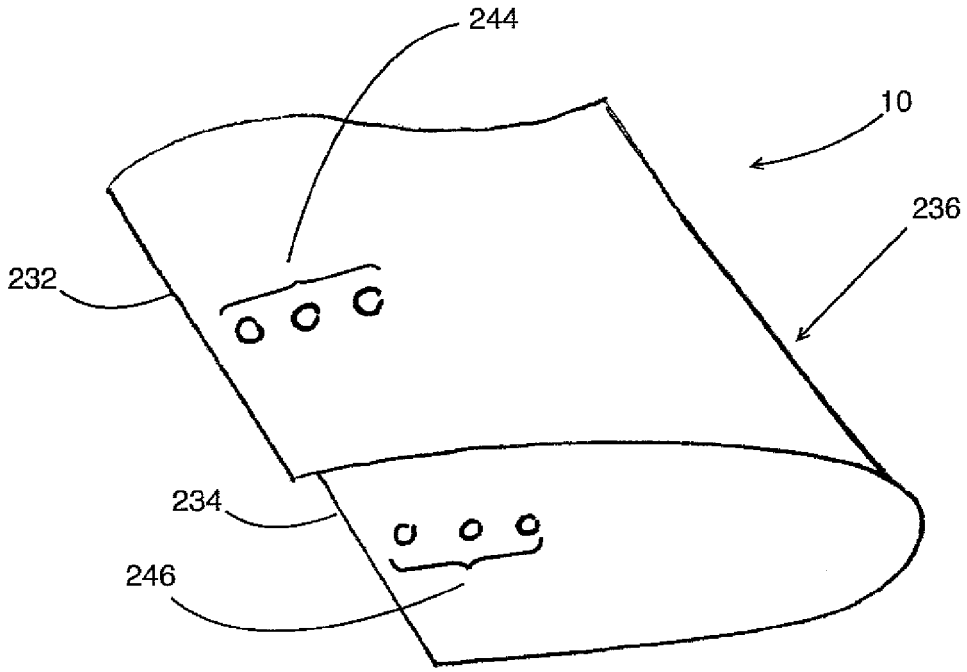
FIG. 30 shows the detail of one set of magnetic fasteners shown in FIG. 29.
Figure 31:
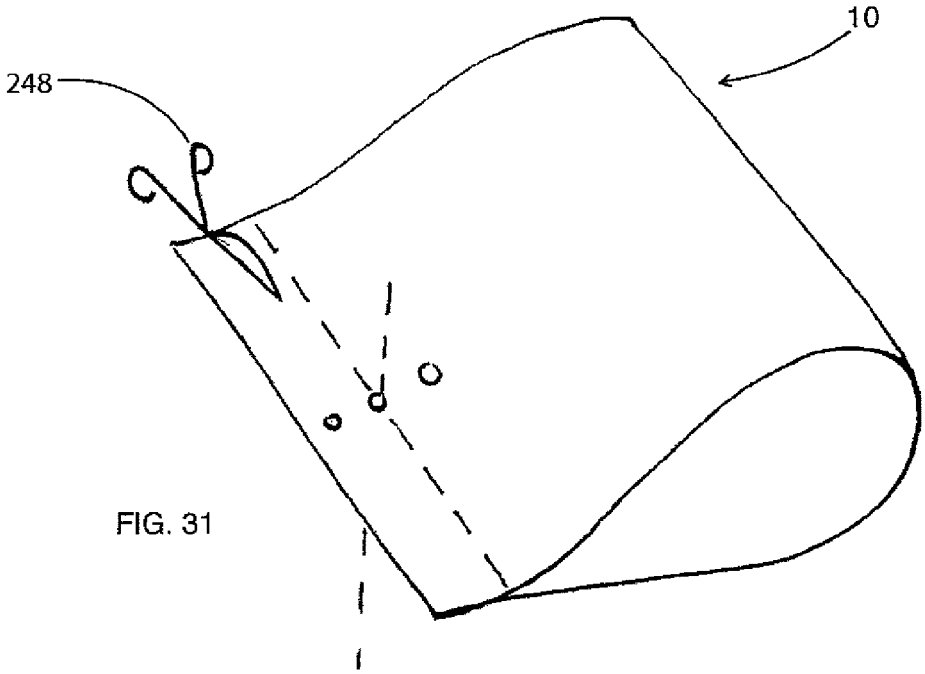
FIG. 31 illustrates the use of sets of magnetic fasteners positioning shown in FIG. 30 to fit a pant leg to a user at a particular position along the length of the pant.

Turning to FIGS. 29 through 31, in another preferred embodiment the inseam edges 232,234 and 233,235 of an unfinished pant 236 are provided with several sets 238, 240 and 242 of several magnetic fasteners 244, 246, corresponding to each edge of the unfinished seam, the sets being distributed along the length of the leg and the magnets being spaced in rows perpendicular thereto. A shown in FIGS. 30 and 31, the magnetic fasteners on opposite edges of the inseam ends are arranged so that opposite polarities face one another. This is so that selected pairs of magnetic fasteners can be stuck together when the right leg width, at a given position along the length of the leg, is determined, as shown specifically in FIG. 31. The extra material may then be cut away, as shown by scissors 246, and the inseam is then stitched. This positioning creates a formula for a skilled seamstress or seamster to finish pant accordingly to customer's fit and personal desire. It is to be understood that, while magnetic fasteners have been disclosed for this purpose by way of example, other types of fasteners, such as snaps and clips for example but not by way of limitation, may be used without departing form the principles of the invention.

The aforedescribed embodiments of a pant and methods of making a pant lend themselves particularly well to novel methods of merchandising custom fit pants. Basically, the methods comprise manufacturing a plurality of partially-completed pants as described above in a plurality of sizes at a production facility, delivering such pants to one or more points of sale, determining key body dimensions of a given purchaser and the customer's fit preferences at the point of sale, then cutting and stitching the left and right inseams, crotch area and leg ends at the point of sale to match the dimensions and preferences of the customer and thereby providing a custom fit once the inseams, any remaining crotch seam and leg ends are stitched.

Several approaches may be taken to obtaining the key body dimensions and preferences of a customer, and then finishing the pant, as shown by FIGS. 32-40.

Figure 32:
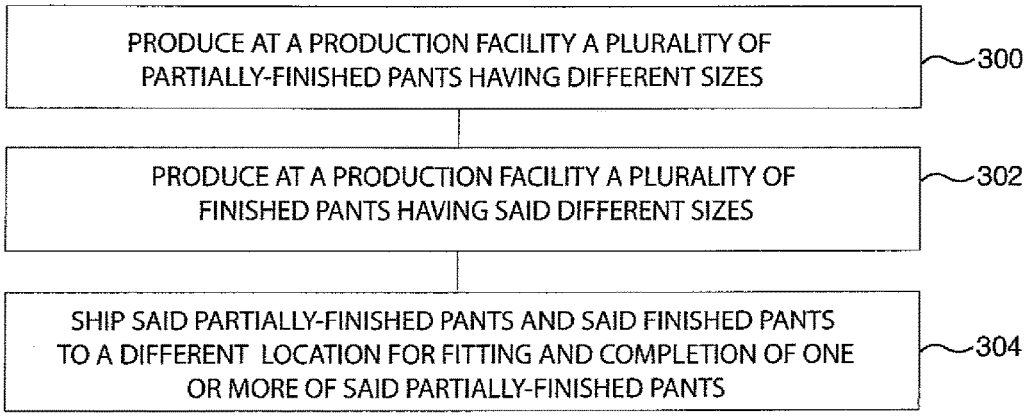
FIG. 32 is a flow chart of a first method of merchandising pants.
Figure 33:
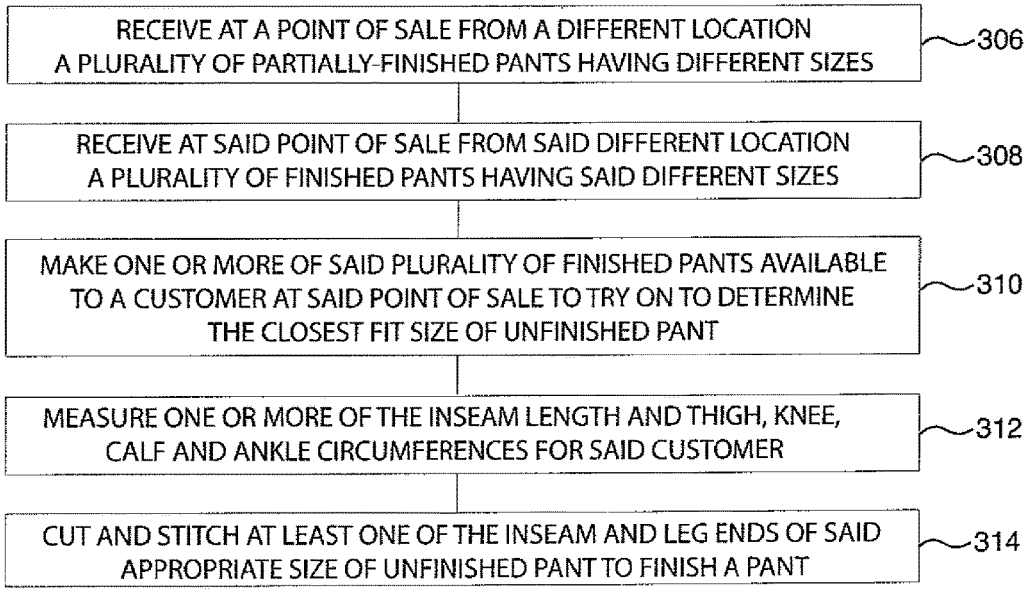
FIG. 33 is a flow chart of a second method for merchandising pants.

One approach combines Method I in FIG. 32 and Method II in FIG. 33. In FIG. 32, the first step, 300, is to produce at a production facility a plurality of partially-finished pants having different sizes. The second step, 302, is to produce at the production facility a plurality of finished pants of the same type having different sizes. The third step, 304, is to ship to a different location, ordinarily a point of sale, unfinished pants of the type described herein in a plurality of standard size ranges and a plurality of completely finished pants of the type described herein. This enables the finished pants to be tried on at the point of sale as a way of determining the right size and fit of unfinished pant to be custom finished for the purchaser at the point of sale.

In Method II of FIG. 33, the first step 306 is to receive from a different location, ordinarily a production facility, at a point of sale a plurality of partially-finished pants having different sizes, then, at step 308, to receive from that different location at the point of sale a plurality of finished pants having said different sizes. The next step, 310 is to make one or more of the plurality of finished pants available to a customer at the point of sale to try on to determine the size of pant having to closest fit for a given customer. Then, in step 312, key measurements of the customer in relation to that closest fit are made to determine the best fit for that customer based on the customer's style preferences. In step 314 those measurements are translated to the closest unfinished pant, which is cut and stitched at the inseams and crotch seam, as needed, to finish the pant. The finished patent is then delivered to the customer at or from the point of sale.

Figure 28:
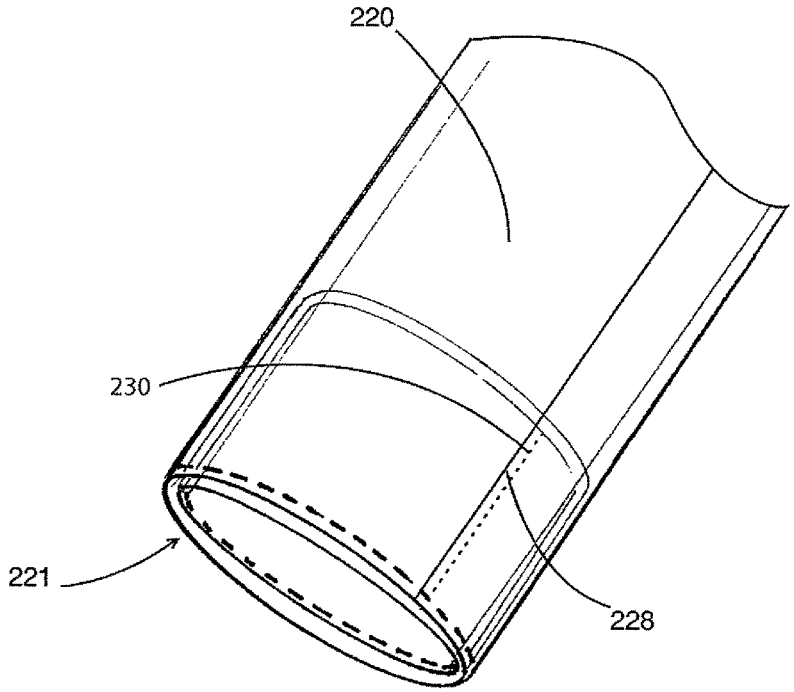
FIG. 28 is a perspective of the right side portion of FIG. 25, finished.
Figure 34:
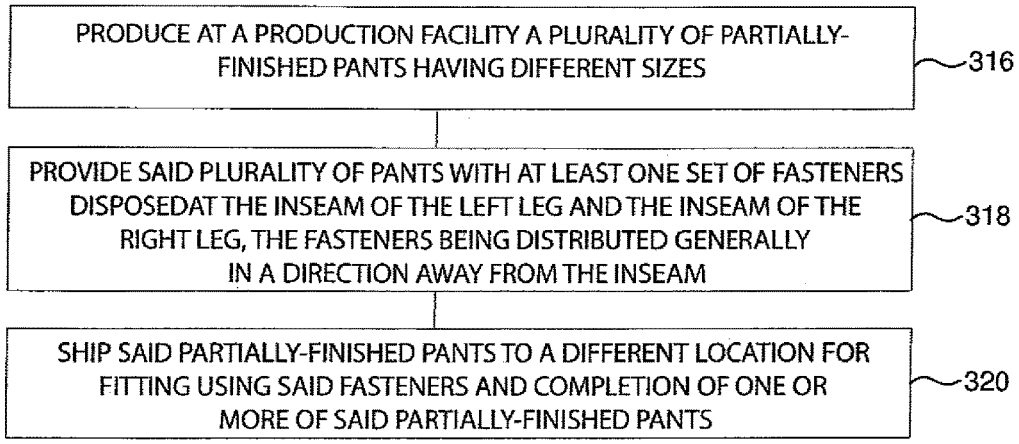
FIG. 34 is a flow chart of a third method of merchandising pants.
Figure 35:
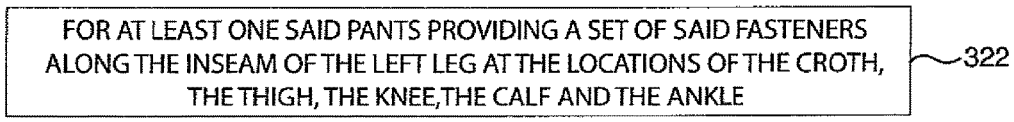
FIG. 35 is a flow chart of a fourth method of merchandising pants.
Figure 36:
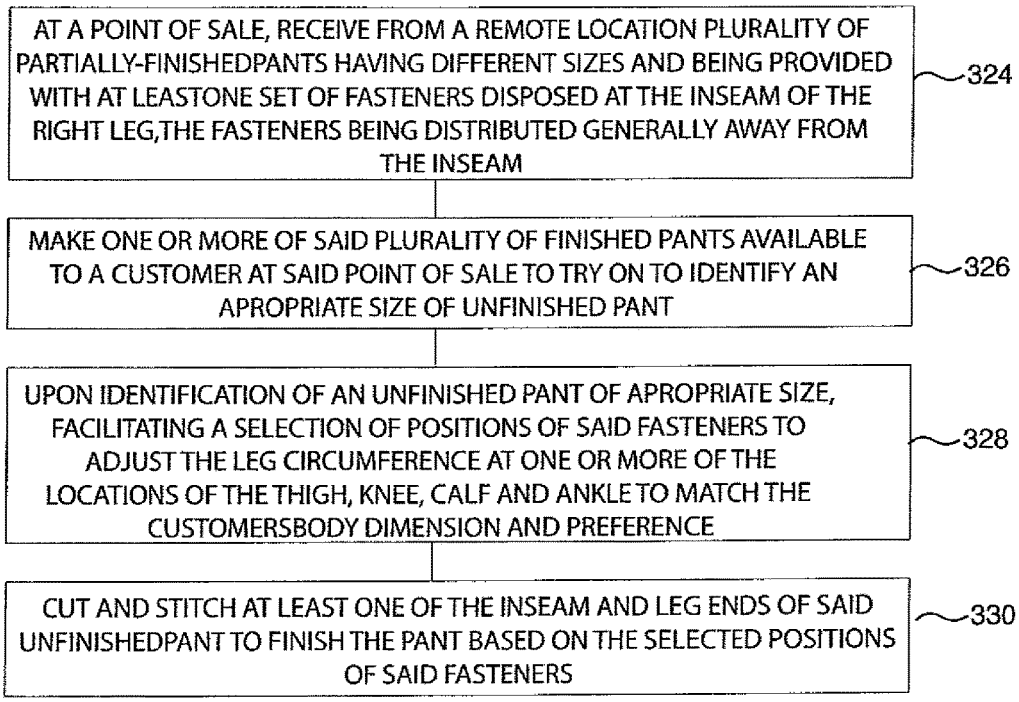
FIG. 36 is a flow chart of a fifth method of merchandising pants.

A second approach combines Method III, shown in FIG. 34, and Method IV, shown in FIG. 35, or Method V, shown in FIG. 36, or both Method IV and Method V. Turning to FIG. 34, in Method HI a plurality of partially-finished pants having different sizes are produced at a production facility, as shown in Step 316. Then, in step 318, those pants are provided with at least one set of fasteners disposed at the inseam of the left leg and inseam of the right leg and distributed generally in a direction away from the inseam, as shown in FIG. 28. In step 320 of Method III, the partially-finished pants are then shipped to a remote location, ordinarily a point of sale. for fitting using the fasteners and completion of one or more of the pants by cutting and stitching material at the inseams.

Method IV adds to Method III the step 322 of providing a set of fasteners along the inseam of the left leg and the right leg at the crotch, the thigh, the knee, the calf and the ankle.

Method V, shown in FIG. 36, includes at step 324 receiving at a remote location, ordinarily a point of sale, partially finished pants having different sizes and provided with one or more sets of fasteners disposed at the inseam of the legs, preferably extending away from the inseams. Then, in step 326, the unfinished pants are made available to customers try on to identify an appropriate size of unfinished pant. Upon identification of an unfinished pant of appropriate size for a given customer, the selection of positions of the fasteners to adjust the leg circumference at one or more locations of the thigh, knee and ankle is facilitated to match the customer body dimensions and preferences. For the sake of modesty, this may be accomplished by providing the pants to a customer to take into a changing room so that the customer can select and use the fasters that make the pant most suitable for the customer's size, fit and style preferences. Then, in Step 328, the selected pant is cut and stitched to finish the pant for the customer.

Figure 37:
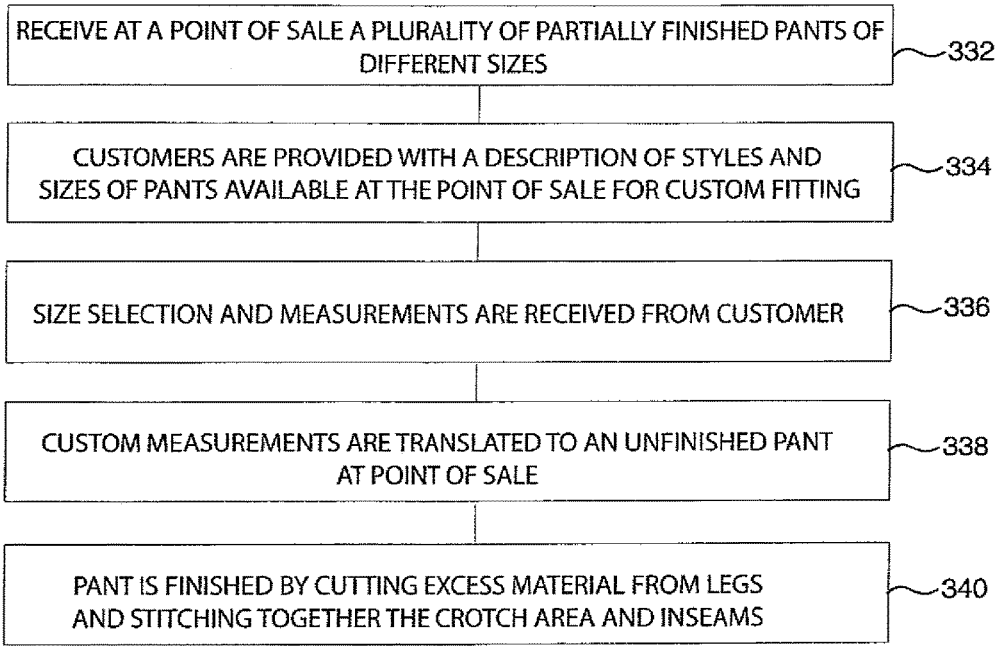
FIG. 37 is a flow chart of a sixth method of merchandising pants.
Figure 38:
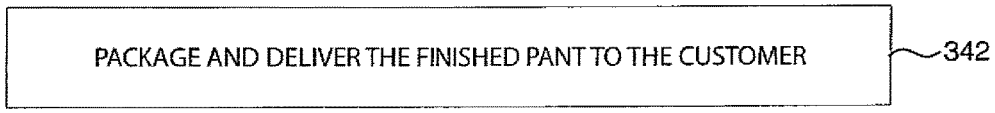
FIG. 38 is a flow chart of a seventh method of merchandising pants.
Figure 39:
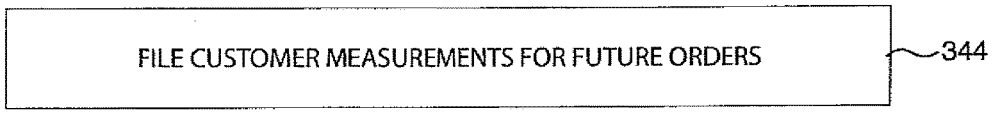
FIG. 39 is a flow chart of an eighth method of merchandising pants.

A third approach combines Method VI, shown in FIG. 37, Method VII, shown in FIG. 38, and Method VIII, shown in FIG. 39. In Method VI, a plurality of partially finished pants of different sizes are received at a point of sale, as shown by Step 332. In step 334, potential customers are provided with a description of styles and sizes of pants available at the point of sale for custom fitting. Such customers could be located in a clothing shop, in hotel rooms, in airplanes or elsewhere, other than the production facility. Customers may be instructed how to choose a pant size and style and to make thigh, knee, ankle and inseam measurements. The size selection and measurement are received from the customer in step 336, and translated to an unfinished pant in step 338 at the point of sale. Then, the pant is finished by cutting excess material from and stitching together the crotch area and inseams in step 340. The customer may then pick up the finished pant.

In Method VII the additional step 342 of packaging the finished pant and delivering it to the customer is provided.

In Method VIII, yet another step 344 of filing the customer measurements and identity for future orders form the customer is added. Thus, a customer may communicate the needed information from a remote location to the point of sale and have the finished product delivered to that location.

The terms and expressions that have been employed in the foregoing specification are used therein as terms of description and not of limitation, and there is no intention, in the use of such terms and expressions, to exclude equivalents of the features shown and described or portions thereof, it being recognized that the scope of the invention is defined and limited only by the claims which follow.

The invention claimed is:

1. A method of producing a pant, comprising:

weaving a right portion of the pant using a multi-layer weaving process, the right portion comprising a right waist edge, a right crotch seam edge and right leg inseam edges;

weaving a left portion of the pant using the multi-layer weaving process, the left portion comprising a left waist edge, a left crotch seam edge, and left leg inseam edges, such that a left portion of a fly is formed by separating at least one set of warp threads from another set of warp threads interlaced therewith so as to produce an outer woven fly-cover layer and an inner woven left fly extension layer in a region of the left portion above the left crotch seam portion thereof; and attaching the left portion of the pant to the right portion of the pant by fastening the left crotch seam edge to the right crotch seam edge.

2. The method of claim 1, further comprising stitching a right fly extension to the right portion of the pant above the crotch seam portion thereof and attaching one or more fasteners thereto for engaging the left inner woven fly extension.

3. The method of claim 2, further comprising attaching as a fastener one half of a zipper to the right fly extension and attaching the other half of the zipper to the left fly extension, thereby permitting the fly to be opened and closed with the zipper.

4. The method of claim 2, further comprising attaching a plurality of buttons to the right fly extension and forming corresponding holes in the left fly extension, thereby permitting the fly to be opened and closed with the buttons.

5. The method of claim 2, further comprising weaving one or both of the right portion and the left portion of the pant such that at least one pocket is formed in at least one such portion by separating at least one set of warp threads from another set of warp threads interlaced therewith so as to produce an outer pocket woven layer and an inner pocket woven layer over a region of each such portion.

6. The method of claim 5, further comprising cutting the one or more of the left portion of the pant from a web and the right portion of the pant from a web so as to open layers to create the fly and at least one pocket.

7. The method of claim 2, further comprising stitching an outer woven fly-cover layer and an inner woven left fly extension layer in place.

8. The method of claim 7, further comprising stitching a left yoke to the back top of the left pant member, a right yoke to the back top of the right pant member, a waist band to the top of the pant, and a plurality of belt loops to the waist band.

9. The method of claim 1, further comprising weaving one or both of the right portion and the left portion of the pant such that at least one pocket is formed in at least one such portion by separating at least one set of warp threads from another set of warp threads interlaced therewith so as to produce an outer pocket woven layer and an inner pocket woven layer over a region of each such portion.

10. A method of producing a pant, comprising:

weaving a right portion of the pant using a multi-layer weaving process, the right portion comprising a right waist edge, a right crotch seam edge and right leg inseam edges;

weaving a left portion of the pant using a multi-layer weaving process, the left portion comprising a right waist edge, a right crotch seam edge and right leg inseam edges;

while weaving one or both of the right portion and the left portion of the pant forming at least one pocket in at least one such portion by separating at least one set of warp threads from another set of warp threads interlaced therewith so as to produce an outer pocket woven layer and an inner pocket woven layer in a region of each such portion; and attaching the left portion of the pant to the right portion of the pant by fastening the left crotch seam edge to the right crotch seam edge.

11. The method of claim 10, further comprising cutting the one or more of the left portion of the pant from a web and the right portion of the pant from a web so as to open layers to create at least one pocket.

* * * * *